US005577475A

United States Patent [19]

De Backer et al.

[11] Patent Number: 5,577,475

[45] Date of Patent: Nov. 26, 1996

[54] ENGINE SYNCHRONIZATION

[75] Inventors: Mark De Backer, Armada; Jeffrey R. Drexel, Rochester Hills; William J. Bolander, Ortonville, all of Mich.

[73] Assignee: Saturn Corporation, Troy, Mich.

[21] Appl. No.: 354,191

[22] Filed: Dec. 12, 1994

[51] Int. Cl.[6] ..... F02P 5/00

[52] U.S. Cl. ..... 123/417

[58] Field of Search ..... 123/414, 417, 123/425; 180/197

[56] References Cited

U.S. PATENT DOCUMENTS

| | | | |
|---|---|---|---|
| 5,331,934 | 7/1994 | Asama et al. | 123/417 |
| 5,335,744 | 8/1994 | Takasuka et al. | 180/197 |
| 5,343,843 | 9/1994 | Hamren | 123/425 |
| 5,404,853 | 4/1995 | Ishigami et al. | 123/417 |
| 5,467,752 | 11/1995 | Murao et al. | 123/414 |

*Primary Examiner*—Raymond A. Nelli
*Attorney, Agent, or Firm*—Michael J. Bridges

[57] ABSTRACT

Synchronization of relative engine angular position information is provided in the absence of an absolute engine position input signal by inducing misfires in a known engine cylinder and then monitoring misfire behavior over a test period. If significant misfire activity does not occur in an engine cylinder assumed, in accord with an assumed engine absolute position, to correspond to the known engine cylinder, then the assumed engine absolute position was not correct and is corrected through application of a position offset to the assumed position. Misfires are induced and the absolute position corrected when the engine is operating at a level assumed to be insensitive to the misfires and the correction.

12 Claims, 17 Drawing Sheets

ENGINE SYNCHRONIZATION

FIELD OF THE INVENTION

This invention relates to automotive internal combustion engine control and, more particularly, to a method for determining or verifying internal combustion synchronization.

BACKGROUND OF THE INVENTION

The application of camshaft position sensors in four cycle internal combustion engine control is known generally in the engine control art. Camshaft position sensors and the hardware and software used to process camshaft position sensor signals typically provide information on engine absolute angular position for synchronization of relative position sensor signals, such as signals output from engine crankshaft position sensors. The relative engine position signals are considered "synchronized" when they are properly interpreted to indicate occurrence of individual engine cylinder events.

The camshaft position sensor typically includes a variable reluctance or hall effect sensor positioned to sense passage of a single tooth or notch on the camshaft. Unlike the engine output shaft, the camshaft rotates once for each engine cycle, and thus the sensed passage indicates absolute engine angular position. The cost of the camshaft position sensor and its associated signal processing hardware and software is significant. Furthermore, engine performance may be significantly reduced if the sensor or its associated hardware or software fails to operate properly. For example, cam sensing faults may lead to significant fuel injection timing error, reducing engine performance and increasing engine emissions.

Pursuant to ambitious engine emissions reduction goals, an increasing number of engine diagnostic systems include advanced cylinder misfire diagnostics which attempt to detect engine misfire conditions and to identify the misfiring cylinder. As such diagnostics may already be present on many automotive vehicles, and as such diagnostics detect individual cylinder misfire conditions during combustion events, and as combustion events of individual cylinders may be used to determine absolute engine angular position, it would be desirable to adapt such misfire detection systems to supplant or at least complement camshaft position sensing approaches for use in determining absolute engine angular position.

SUMMARY OF THE INVENTION

The present invention indicates engine absolute position and does not rely on detection of camshaft position. No hardware is required for this position indication over that already available on many conventional engine control systems. This invention may replace conventional camshaft position sensing systems resulting in reduced vehicle cost. Furthermore, this invention may periodically verify camshaft position sensing information to assure a high level of engine performance and low engine emissions levels. Still further, this invention may be used in the event a camshaft position sensing fault is detected, wherein engine angular position may be determined and the engine synchronization verified or corrected accordingly.

More specifically, to determine engine absolute angular position so that relative engine position inputs, such as from a crankshaft position sensor, may be synchronized with actual engine combustion events and then used for precise cylinder-by-cylinder combustion event control, engine misfires are induced in known cylinders of the engine. A conventional misfire detection approach identifies the misfiring cylinders using an assumed engine synchronization, and if the identified cylinders match the induced cylinders, the assumed synchronization is the correct synchronization, and the assumed synchronization is used for conventional engine control operations. If the identified cylinders do not match the induced cylinders, the synchronization must be corrected, by adjusting a pointer which is used to map crankshaft events to actual engine cylinder events.

In accord with a further aspect of this invention, the cylinders are monitored for prior misfires and the induced cylinders are those demonstrating a low prior propensity for misfires, so that distinctions may be more easily made between misfires resulting from inducement and misfires not resulting from inducement.

In yet a further aspect of this invention, the engine operating level is monitored and the misfires only induced when the engine operating level is sufficiently robust that induced misfires will not normally lead to an unstable engine operating condition.

In yet a further aspect of this invention, when the engine is determined to not be properly synchronized, the engine operating level is monitored and the engine synchronization only corrected when the engine is determined to be operating at a sufficiently robust engine operating level that a synchronization correction will not lead to an unstable engine operating condition.

In yet a further aspect in accord with this invention, misfires are only induced in predetermined engine cylinders which are identified as not significantly impacting engine stability when misfires occur therein. In still a further aspect of this invention, misfires are only induced periodically to minimize the impact of the intrusive test of the present invention on engine performance and emissions. The misfire diagnostic then may operate over a predetermined test period during which a number of misfire conditions are induced and the number of diagnosed misfires compared to a misfire threshold to verify engine synchronization.

BRIEF DESCRIPTION OF THE DRAWINGS

The invention may be best understood by reference to the preferred embodiment and to the drawings in which.

DESCRIPTION OF THE PREFERRED EMBODIMENT

Figure 1:
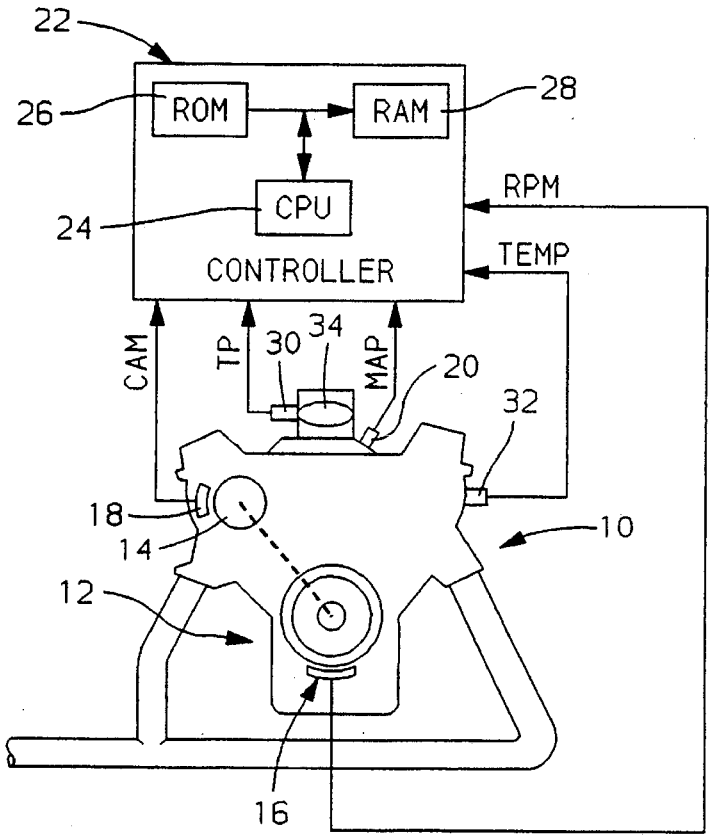
FIG. 1 is a general diagram of the engine control and diagnostics hardware for engine synchronization in accord with the preferred embodiment of this invention.

Referring to FIG. 1, an internal combustion engine 10 having a crankshaft 12 communicates, in the from of periodic signal RPM, passage of a plurality of teeth or notches disposed about the circumference of the crankshaft 12 by a conventional wheel speed sensor, such as a variable reluctance or hall effect sensor 16. A substantially sinusoidal voltage thus is induced across the sensor with a frequency proportional to the rate of passage of teeth or notches by the sensor 16, which is proportional to the rate of rotation of the crankshaft 12. In this embodiment, two teeth (or notches) are disposed about the crankshaft circumference in position to pass the sensor 16, such that with the four cycle, four cylinder engine of this embodiment, four teeth pass the sensor 16 for each engine cycle, or one for each engine cylinder power stroke. The sensor 16 output signal RPM is communicated to an engine controller 22. A camshaft 14 is mechanically associated with the crankshaft 12 to rotate therewith at a proportional rate of rotation wherein the camshaft completes one revolution of rotation for each complete engine cycle. A tooth or notch is disposed on the camshaft and a camshaft position sensor 18 which may be a conventional variable reluctance or hall effect sensor is fixedly positioned relative to the camshaft to sense passage of the tooth or notch as the camshaft rotates, and to output signal CAM having a signature indicating the time of tooth or notch passage. The signal CAM is used to attribute an absolute engine angular position to the engine cylinder events indicated by the signal RPM. For example, in the four cylinder engine application of the present embodiment, voltage crossings of the signal RPM occur once for each engine cylinder event, such as each cylinder combustion event. Each of the two teeth disposed on the crankshaft for this purpose may be distinguished by placing an offset notch or tooth in an offset position on the crankshaft and sensing passage thereof, and comparing the time of passage of the offset tooth or notch to that of the other two teeth. The tooth closest to the offset tooth may be identified, for example, and attributed to combustion events in two of the four engine cylinders. The camshaft position sensor signal CAM indicates which of the two cylinder combustion events each passage of that tooth corresponds to, as is generally known in the art.

A manifold absolute pressure MAP sensor 20 is located in the intake manifold of the engine and communicates signal MAP indicating such pressure. In an alternative embodiment, a mass airflow sensor (not shown) may be used to measure the mass of air inlet to the engine 10, for example to determine engine load, which is amount of air the engine consumes per cylinder event. Further conventional engine parameter sensors may be included in accord with the present embodiment, including but not limited to an engine throttle position sensor 30 for transducing the position of an engine inlet air valve 34 and communicating output signal TP indicating the valve position, an engine coolant temperature sensor 32 for transducing engine coolant temperature and four outputting signal TEMP indicative thereof.

The controller 22 may be an eight bit, single-chip microcomputer, such as a Motorola MC68HC11, having read only memory ROM 26, random access memory RAM 28, and a central processing unit CPU 24. The CPU 24 executes a series of programs to read, condition, and store inputs from vehicle sensors and, with the information provided by the inputs, control operation of engine 10 such as through conventional engine fueling control in accord with fuel pulse command FP delivered to conventional fuel injector drivers 36. The drivers 36 issue timed fuel injection pulses to fuel injectors (not shown) indicating, as is generally understood in the art, the timing and the quantity of fuel to be delivered by such injectors. Each injector corresponds to an engine cylinder.

Among the routines used for engine control are those illustrated in FIGS. 2–15. When a cam fault is detected, these routines, in accord with this invention, verify and, if necessary, correct an engine absolute position indication which corresponds to an engine synchronization to resynchronize the engine. The cam fault is detected if input information from the cam sensor deviates significantly from an expected input pattern. Engine absolute position is verified by inducing an engine misfire, such as by temporarily shutting off fuel to a cylinder, and then monitoring misfire activity in the cylinder, such as through application of any known misfire diagnostic capable of detecting engine misfire conditions and of identifying individual misfiring cylinders. The misfire diagnostic relies on the assumed engine angular position that is to be verified. Therefore, if the cylinder in which the misfire is induced during a test period is not the cylinder identified as misfiring, but rather the cylinder opposite the induced cylinder (the cylinder that shares a crankshaft tooth or notch with the induced cylinder) is identified as misfiring, then the engine angular position must be corrected, as the tooth or notch is "out of sync" with the engine angular position. Otherwise, if the induced cylinder is the cylinder identified as misfiring, the engine is "in sync." While any of a wide variety of misfire diagnostic routines may operate with the engine synchronization approach of invention, the misfire detection approach disclosed in U.S. patent application Ser. No. 08/236812, filed May 2, 1994, assigned to the assignee of this application, is used in accord with the preferred embodiment of this invention.

Figure 2:
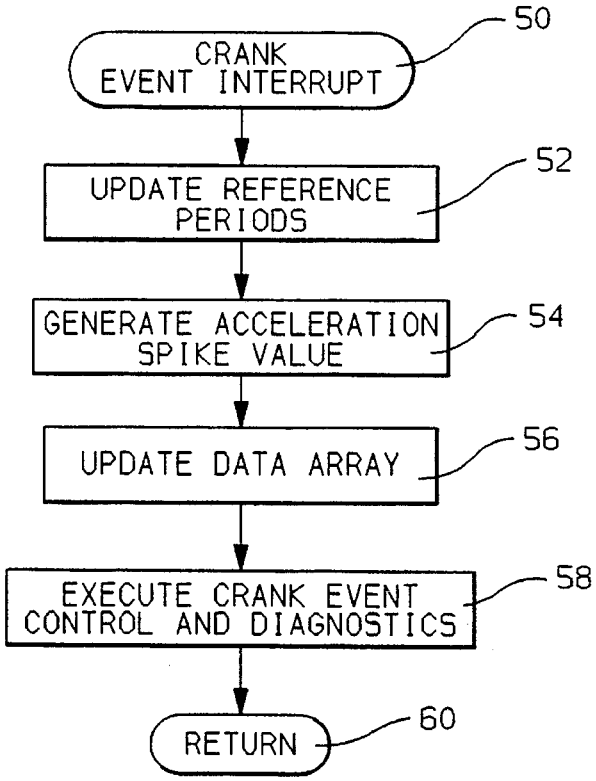
FIGS. 2–15 are computer flow diagrams illustrating a sequence of operations used for the engine synchronization in accord with the preferred embodiment.

First among the routines of the preferred embodiment is that of FIG. 2, which is executed beginning at a step 50 upon detection of an engine crank event, such as may correspond to a cylinder event in the engine. For example, an engine crank event may be set up to occur each time the periodic crankshaft signal from sensor 16 cycles, at a time in each cycle corresponding to a combustion event in a corresponding cylinder. As such, in the four cylinder, four cycle engine of this embodiment, a crank event will occur once for each combustion event in the engine. Upon occurrence of each such event, the controller 22 (FIG. 1) is configured to vector control to the interrupt service routine of FIG. 2, to appropriately service the interrupt and to carry out engine control and diagnostic routines, including routines for engine angular position detection and for misfire detection.

Figure 3:
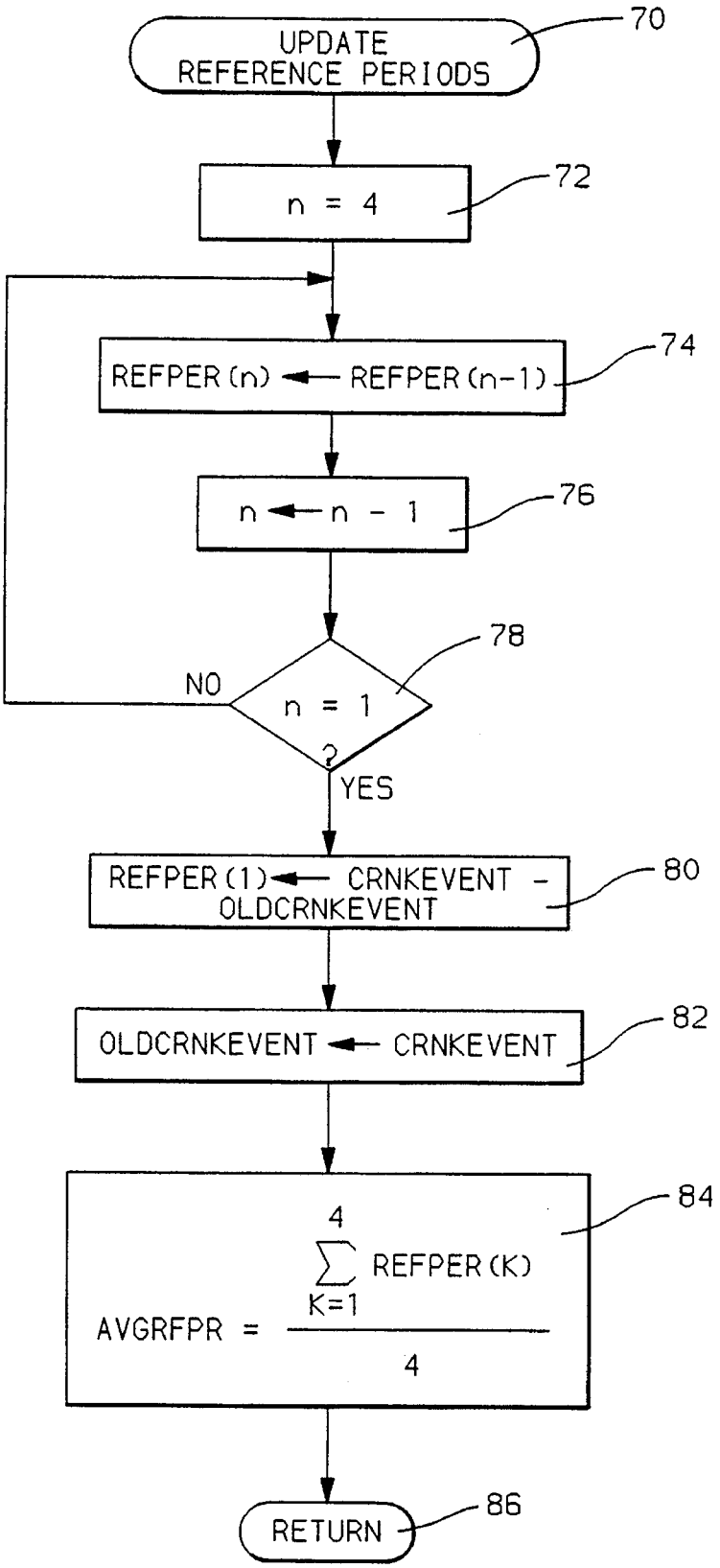
Figure 6:
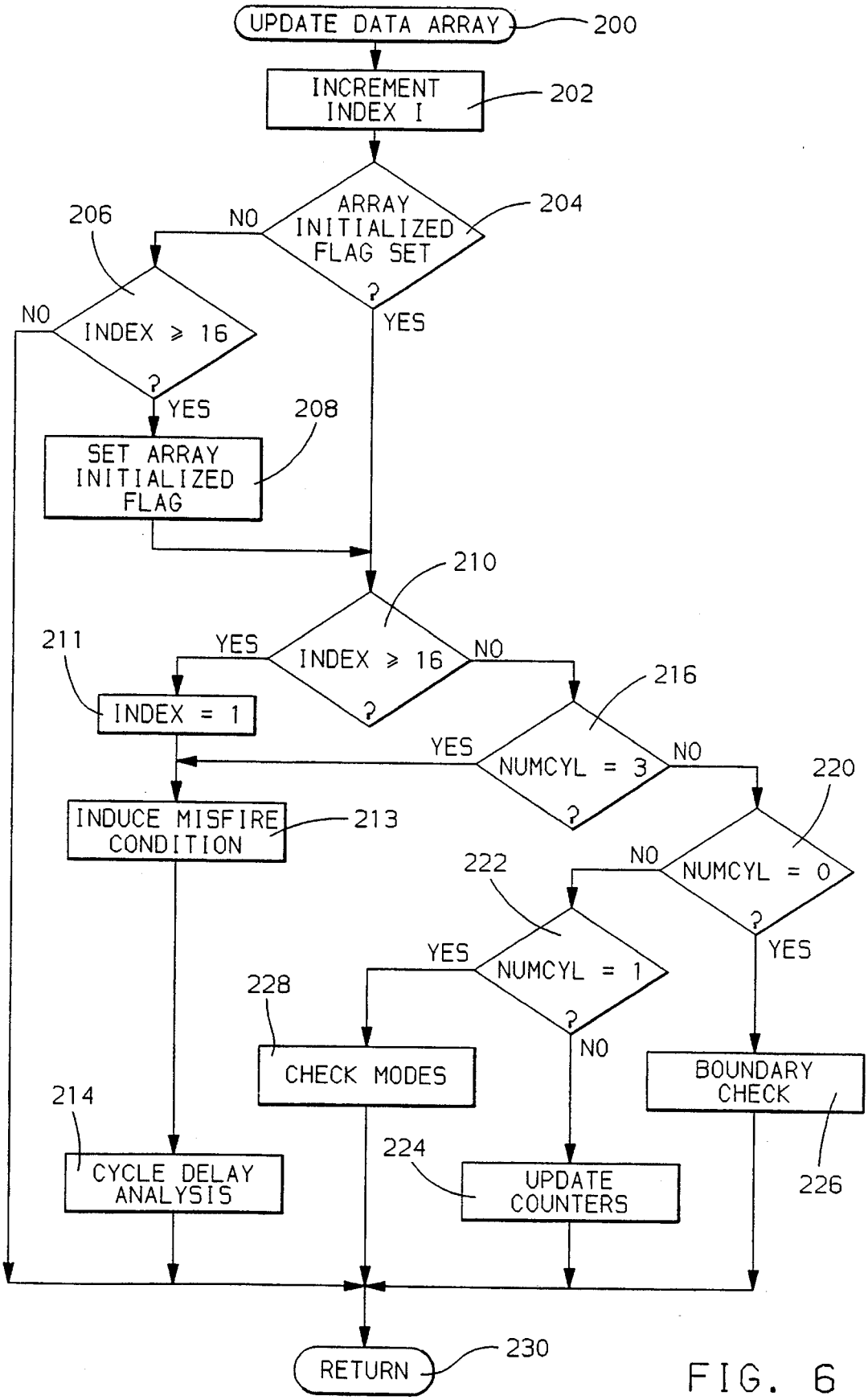

Returning to FIG. 2, upon detecting the crank event, the controller 22 (FIG. 1) is configured to execute the routine of FIG. 2, starting at the step 50 and proceeding to a step 52, at which a routine to update reference periods, illustrated herein as FIG. 3, to be described, is executed. After executing the routine to update reference periods via the step 52, the routine of FIG. 2 proceeds to a step 54 to execute a routine to generate an acceleration spike value, illustrated herein as FIG. 4, to be described. Next in FIG. 2, a step 56 is executed at which a routine to update a data array is called. The routine to update the data array is illustrated in FIG. 6, to be described.

The routine of FIG. 2 next proceeds to a step 58 to execute any conventional crank event control and diagnostics functions that may be necessary in accord with conventional engine control and diagnostics practice. Specifically, conventional routines to control engine fuel and ignition may be executed as well as routines to carry out conventional engine diagnostics. Upon completion of any of such engine control and diagnostic routines needed during the present crank event interrupt, as outlined at the step 58, the routine of FIG. 2 proceeds to a step 60 to return to any operations that were ongoing prior to the occurrence of the present crank event. The routine of FIG. 2 will, as described, be periodically executed in the manner described to service engine crank event interrupts.

Referring to FIG. 3, the routine to update reference periods is illustrated. This routine maintains a series of four most recent consecutive time difference values, called REFPER values, for use in misfire detection. Specifically, at a step 72, an index value n is reset to four for use in the present routine and then steps 74 through 78 are executed to update the three most recent prior REFPER values so as to maintain the most recent REFPER values for later use in this embodiment. After executing the steps 74, 76 and 78, for the three most recent REFPER values, the routine proceeds to a step 80 to generate the present REFPER value, denoted by index 1, as the difference between the time of the present crank event CRNKEVENT and the time of the most recent prior crank event OLDCRNKEVENT. This time difference is representative of the speed of the engine during this most recent reference period.

After generating REFPER(1), the routine of FIG. 3 proceeds to a step 82 to store CRNKEVENT as OLDCRNKEVENT, for use in the next iteration of this routine. The routine then proceeds to a step 84 to generate an average reference period value AVGRFPR as the average of the most recent four reference period values, as maintained through the routine of FIG. 3. After the step 84, the routine proceeds to a step 86 to return to the step 52 of the routine of FIG. 2 from which this routine was called.

Figure 4:
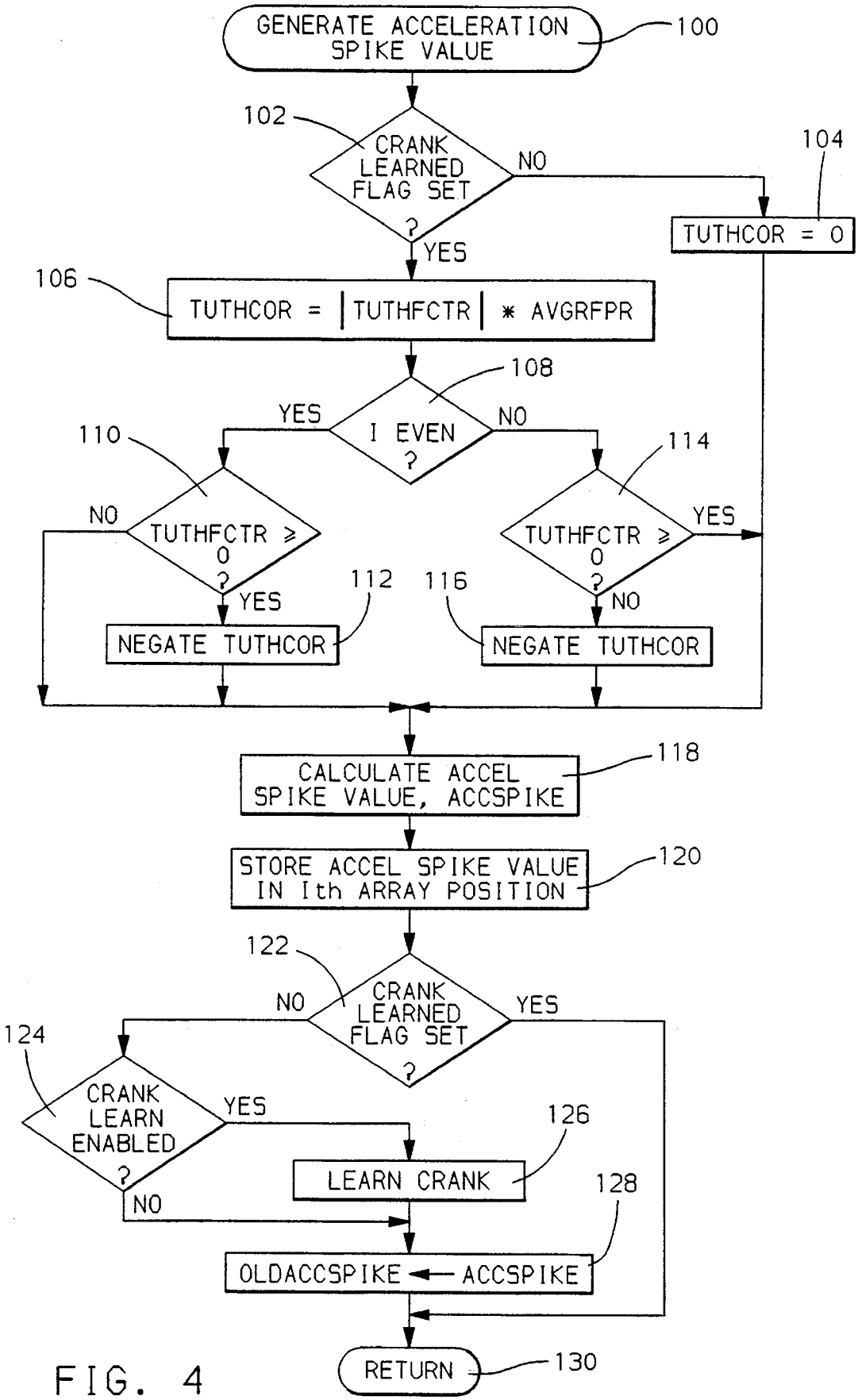

Turning to FIG. 4, the routine to generate an acceleration spike value is illustrated. An acceleration spike value is defined as a relatively large decrease in engine speed immediately followed by a significant increase in engine speed. Mathematically, the acceleration spike value is generated using reference period information from the most recent four reference period values, as described in FIG. 3, to magnify this acceleration spike information. When the acceleration spike information is thus magnified, it may be used to diagnose a misfire, and to distinguish the acceleration information from other engine acceleration sources such as driving over rough roads, or shifting or clutching of the powertrain by an operator.

Specifically, the routine of FIG. 4 is entered at a step 100 and proceeds to a step 102 to determine whether a crank learned flag has been set. The crank learned flag indicates whether the crank tooth error information required in accord with the misfire diagnostic used in the present embodiment of this invention has been learned for the particular crankshaft of this embodiment. The misfire diagnostic used in accord with the present invention reduces crankshaft tooth spacing variation sensitivity by learning crank tooth error and by incorporating the learned crank tooth error into the misfire detection approach. The crank tooth error learning may occur at initial operation of the engine 10, and may thereafter be relied on for misfire detection. For example, upon initially operating the engine, crank tooth learning may occur and a value representing crank tooth error permanently stored for use, or at least stored until such time as crankshaft replacement may occur.

Returning to FIG. 4, if the crank learned flag is set at the step 102 indicating that the crank tooth error has been learned, the routine proceeds to a step 106 to generate a tooth correction value as a product of the magnitude of the tooth factor, to be described, and the average reference period generated in FIG. 3. After generating the tooth correction value at the step 106, the routine proceeds to a step 108 to determine if an index value I is even.

Generally, the tooth correction provided in this embodiment may be positive or negative depending on which portion of the crankshaft the most recent reference value occurred over. The crankshaft of the present embodiment has two teeth disposed thereon. Any unevenness in the spacing of the two teeth will result in a bias between reference periods. The tooth correction value will attempt to account for such differences, and will change in sign for every other crank event. Accordingly, through the steps 108–116 of FIG. 4 sign correction is provided on every other crank event.

Specifically, at step 108 if the index I is even, the routine proceeds to a step 110 to determine if the tooth factor is greater or equal to zero. If the tooth factor is not greater or equal to zero, no sign correction is required and the routine proceeds directly to a step 118. Alternatively, if the tooth factor is greater or equal to zero, sign correction needs to be applied, and the routine moves to a step 112, to negate TUTHCOR, after which the routine proceeds to the step 118.

Returning to step 108, if I is odd, sign correction may be required as well. Accordingly, the routine proceeds to step 114 to determine if tooth factor is greater than or equal to zero. If so, no sign correction is required and the routine proceeds directly to step 118. However, at the step 114, if tooth factor is less than zero the routine must carry out a sign correction to apply TUTHCOR properly, by proceeding to a step 116 to negate TUTHCOR, and then proceeds to the step 118.

After correcting the tooth correction value for sign errors, the step 118 calculates the acceleration spike value ACCSPIKE, as follows

ACCSPIKE(K)=−REFPER(K)+3 * REFPER(K+1)−3 * REFPER(K+2)+REFPER(K+3)+TUTHCOR which is a simplified form of an equation that combines, with the tooth correction value, the magnitude of a deceleration corresponding to the cylinder assumed to be responsible for the present crank event and the magnitude of the acceleration immediately following that deceleration. Accordingly, if that deceleration and the following acceleration were both relatively large in magnitude, the acceleration spike value ACCSPIKE would be substantially large, and may indicate an engine misfire, as will be described.

After generating the acceleration spike value at the step 118, the routine proceeds to a step 120 to store the acceleration spike value in the Ith array position in an array of sixteen acceleration spike values, as is needed for the present routine. The array of sixteen acceleration spike values will be used in determining a presence of any misfire in the engine, as will be described.

After storing acceleration spike value at the step 120, the routine of FIG. 4 proceeds to a step 122 to discern whether the crank learned flag has been set. If the flag is set, no crank tooth error learning is required, as described, and the routine proceeds to a step 130 to be described. Alternatively, if the crank learned flag is not set, then crank learning is required and the routine proceeds to a step 124 to determine if crank learn is enabled. Crank learn will be enabled, as will be described, when conditions are appropriate for crankshaft tooth error learning. If crank learning is enabled, then the routine proceeds to a step 126 to execute a routine illustrated in FIG. 5 to learn crank tooth error, as will be further detailed.

After executing the routine to learn crank, the routine of FIG. 4 proceeds to a step 128 to store ACCSPIKE, the presently determined acceleration spike value as OLDACCSPIKE, for later use, as will be described. Next, or if the crank learn flag was set at the step 122, the routine proceeds to a step 130 to return to the routine of FIG. 2, from which the routine of FIG. 4 was called.

Figure 5:
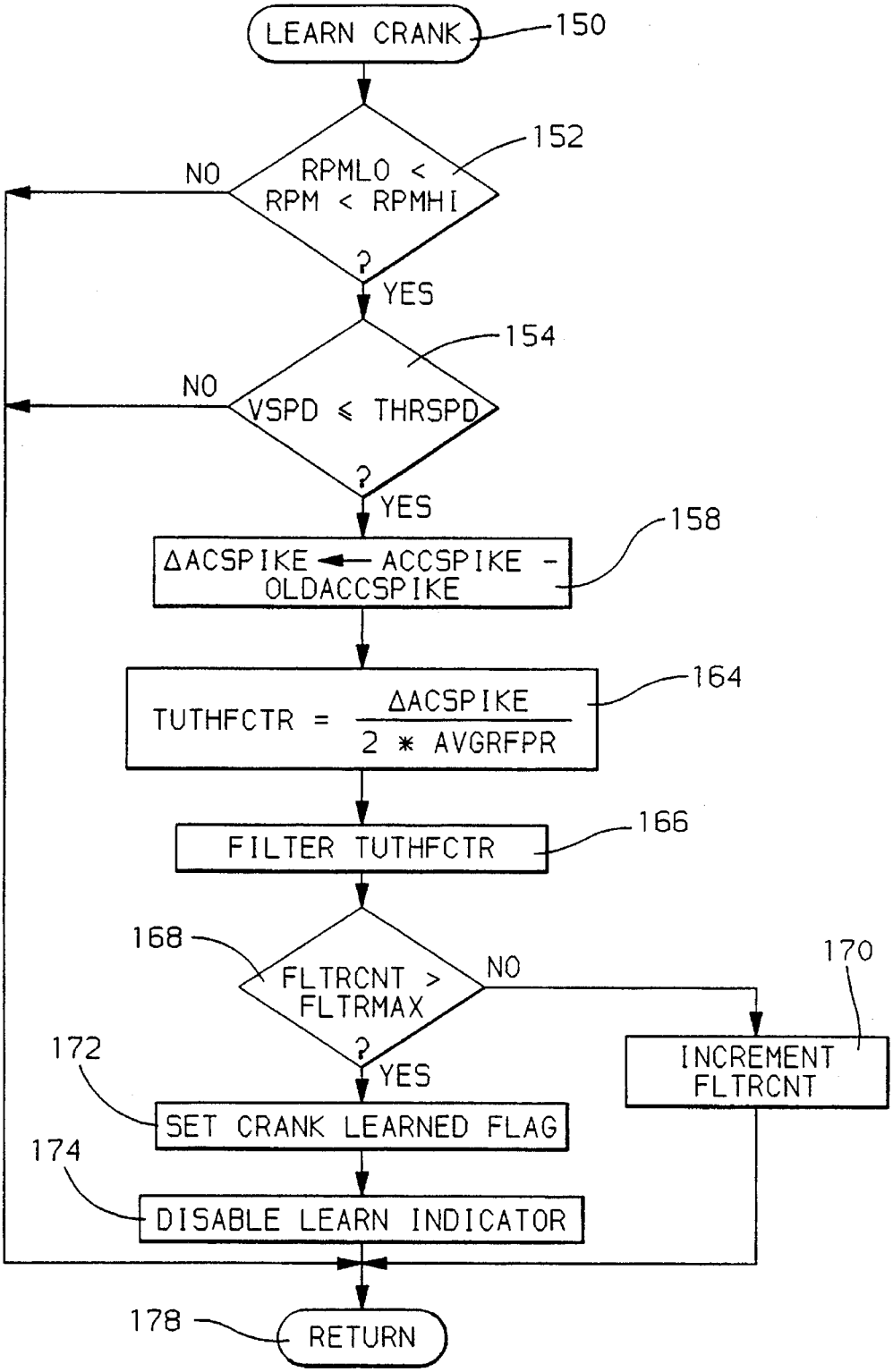

Referring to FIG. 5, the routine to learn crank tooth error is illustrated, as called from step 126 of FIG. 4, starting at the step 150. The routine proceeds from step 150 to a step 152 to compare engine speed RPM to an engine speed range defined by speed range boundary values RPMLO and RPMHI. In this embodiment, RPMLO may be set to 3,000 r.p.m. and RPMHI may be set to 4,000 r.p.m., between which is thereby defined a range of engine speeds within which a representative tooth learning value may be generated. If engine speed RPM is within the engine speed range at the step 152, the routine proceeds with the crank learning. Otherwise, the crank learning is not carried out and the routine of FIG. 5 is exited at a step 178 and returns to the described step 126 of FIG. 4 from which the present routine was invoked.

Returning to the step 152, if engine speed RPM is within the RPM range, the routine proceeds to the step 154 to compare vehicle speed VSPD to a threshold vehicle speed THRSPD. Vehicle speed may be generated through a conventional wheel speed sensor or through a conventional transmission cable to indicate the speed of motion of the vehicle within which the engine 10 is installed. The threshold speed THRSPD is calibrated to a small value slightly greater than zero speed. Therefore, the comparison at the step 154 is to determine if the vehicle is in neutral, or substantially not moving. In this embodiment, the crank learning routine of FIG. 5 is set up to learn tooth to tooth variations when the engine speed is within the described predetermined range and when the vehicle is substantially in neutral, to improve the quality of the tooth learning information retrieved. If the vehicle is not determined to substantially be in neutral at the step 154, the crank learning is disabled for the present crank event by proceeding to the described step 178.

Alternatively at the step 154, if the vehicle is determined to substantially be in neutral, the routine proceeds with the crank learning by moving to a step 158 to generate a difference value ΔACSPIKE, as the difference between the present acceleration spike ACCSPIKE and the most recent determined acceleration spike OLDACCSPIKE. This difference value represents the acceleration spike difference due to crankshaft tooth-to-tooth variations.

After generating ΔACSPIKE at the step 158, the routine proceeds to a step 164 at which a tooth factor TUTHFCTR is generated as follows

TUTHFCTR=ΔACSPIKE/(2*AVGRFPR)

wherein ΔACSPIKE values is halved so that it is the portion of the acceleration spike only to tooth error, and further is divided by the average reference period value AVRGFPR to normalize the tooth factor for engine speed.

After generating TUTHFCTR at the step 164, the routine of FIG. 5 proceeds to a step 166 to filter TUTHFCTR by passing it through a conventional lag filter process as is generally known in the art, to reduce the impact of signal and system noise on the precision of the estimate of the acceleration spike error. Next, the routine moves to a step 168 to compare a filter count FLTRCNT, which is the number of filter values applied in the lag filter process of step 166, to a maximum value FLTRMAX. The value FLTRMAX is set, in this embodiment, to approximately 400 to ensure that 400 tooth factors have gone into the filtering process of step 166 before a precise tooth factor is assumed to be present.

Accordingly, at the step 168, if FLTRCNT does not exceed FLTRMAX, the routine proceeds to a step 170 to increment FLTRCNT and then exits the routine of FIG. 5 at the described step 178. Alternatively, if FLTRCNT exceeds FLTRMAX at the step 168, the routine proceeds to a step 172 to set a crank learned flag, to indicate crank learning is complete, and then proceeds to a step 174 to disable any learn indicator that may have been present, such as an indicator to a technician that crank learning must yet be carried out to properly prepare the controller 22 (FIG. 1) for misfire detection. For example, a flashing light on the instrument panel of an automotive vehicle would indicate such a need for learning to the technician. Accordingly, upon learning crank information through the routine of FIG. 5 and after a sufficient number of tooth correction factors have gone into the filtering of TUTHFCTR, the learn indicator may be disabled at the step 174, and the routine exited via the described step 178.

Referring to FIG. 6, the routine to update the data array is described. When called from the described step 56 of the routine of FIG. 2, this routine starts at a step 200, and proceeds to a step 202 at which the index I is incremented to point to the next position in the sixteen entry data array of this embodiment. After incrementing the index, the routine proceeds to a step 204 to determine if an array initialized flag has been set.

If the array initialized flag is not set at the step 204, the routine proceeds to a step 206 to compare the index value I to the size of the data array of the present embodiment, which has been set to sixteen. If the index value exceeds or is equal to sixteen, the routine proceeds to a step 208 to set the array initialized flag to synchronize the operation of the routine of FIG. 6 to start at the beginning of the array pointed at by the index I. After setting the array initialized flag the routine proceeds to a step 210, to be described. Returning to step 206, if the index I is not greater than or equal to sixteen, the routine proceeds to a step 230 at which it is directed to return to the routine of FIG. 2 from which the routine of FIG. 6 was called.

Figure 7:
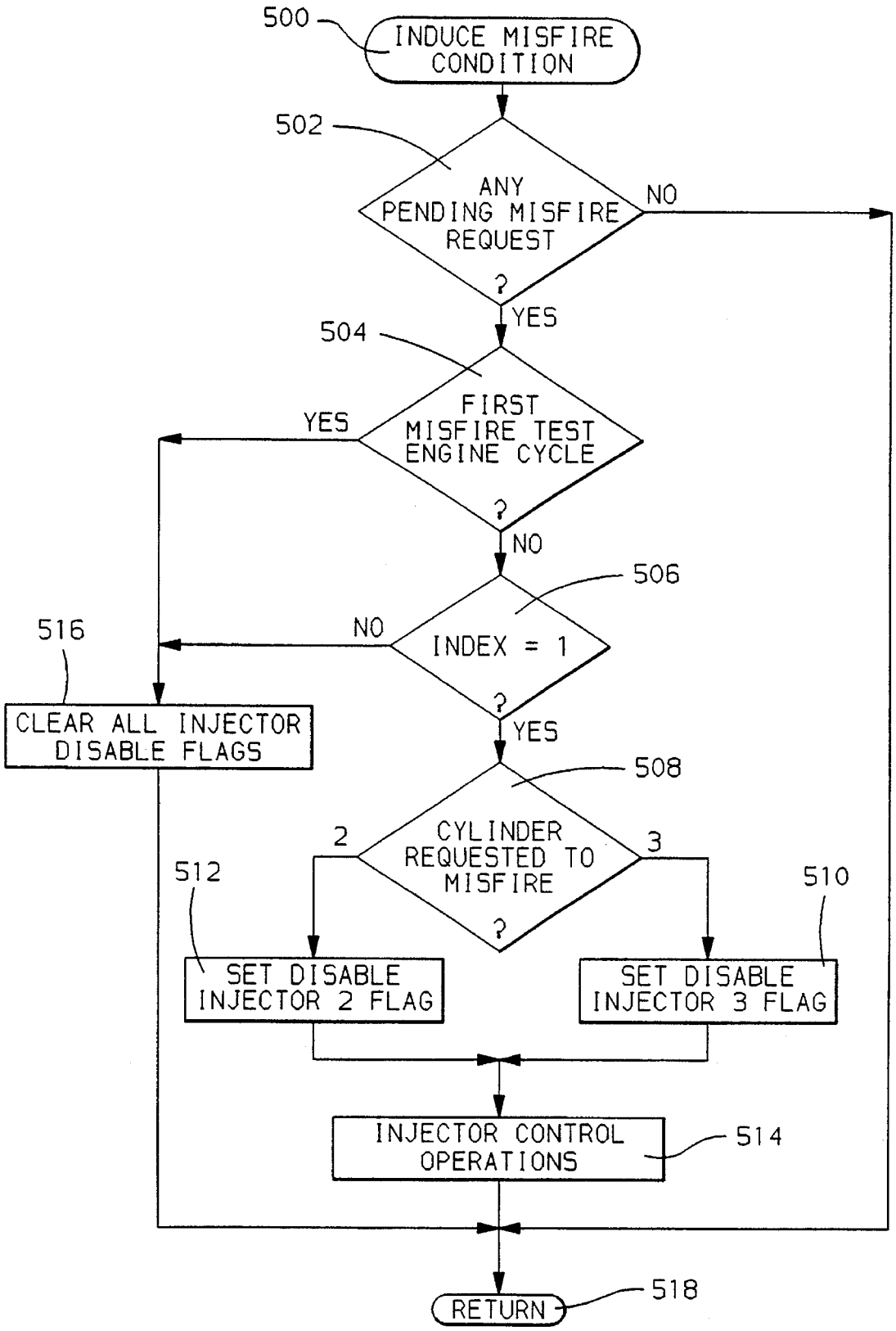

Returning to the step 210, if the index I is greater than or equal to 16 indicating that the 16 entry data array of the present embodiment is full, the routine resets the index to one at a step 211 and then proceeds to a step 213 to execute a routine, illustrated in FIG. 7, to be described, which routine may be used to induce a misfire condition for engine synchronization verification and correction. After execution of the routine of FIG. 7, the routine of FIG. 6 proceeds to a step 214 to execute a cycle delay analysis as will be described in FIGS. 8*a* and 8*b*, and then proceeds to step 230 to return to the routine of FIG. 2 from which the present routine was called. Alternatively at the step 210, if the index I is less than 16, a step 216 is executed at which the pointer NUMCYL is compared to the value three. NUMCYL indicates a position in the engine cylinder firing order and is maintained in a conventional engine control loop not described herein. Generally, NUMCYL starts at zero, and is incremented each time an engine cylinder event occurs, and returns to zero after reaching a value corresponding to the number of cylinders in the application. For example, in the four cylinder engine of this embodiment, NUMCYL would start at zero, and be incrementally increased to three, and then would restart at zero, etc. In the event of a cam position sensor fault condition, NUMCYL may represent only an assumed engine angular position, which assumed position would be used for the present conventional misfire diagnostic and which position would be verified through operation of the engine position verification and correction operations of this embodiment.

Returning to the step 216, NUMCYL is compared to three to determine if present engine cylinder event interrupt was caused by the final cylinder firing event in the firing order. If so, the routine proceeds to the described step 213 to execute the induce misfire condition routine of FIG. 7. Alternatively at the step 216, if NUMCYL does not equal three, the routine proceeds to a step 220 to determine if NUMCYL equals zero, indicating the present interrupt corresponds to a cylinder event in the first cylinder in the firing order.

If NUMCYL equals zero at the step 220, the routine proceeds to a step 226 to carry out a boundary check as will be described in the routine of FIG. 11, and then proceeds to the described step 230. Alternatively at the step 220, if NUMCYL does not equal zero, the routine proceeds to a step 222 to determine if NUMCYL equals one, corresponding to the second cylinder of the firing order. If NUMCYL equals one at the step 222, the routine proceeds to a step 228 to check modes via the routine of FIG. 12, to be described. After executing the routine of FIG. 12, the routine of FIG. 6 proceeds to the described step 230.

Returning to the step 222, if NUMCYL does not equal one, the routine proceeds to a step 224 to execute a routine illustrated in FIGS. 10*a* and 10*b*, to update misfire counters, as will be described. After executing the routine of FIGS. 10*a* and 10*b*, the routine of FIG. 6 proceeds to the described step 230. As illustrated in the described routine of FIG. 6, distribution of the tasks supporting the engine angular position verification through detection of induced misfires in accord with this invention is provided, wherein certain of the tasks are carried out for each of the crank events of the engine cycle. In other words, the burden of carrying out all of the tasks required for this embodiment is not levied on any one iteration of the present routine, but rather is divided among the four cylinder event interrupts of each engine cycle. This distribution provides for a sufficient amount of time for each of the tasks to be carried out on each cylinder event without constraining too significantly the throughput capabilities of the controller of this embodiment.

The routine to induce misfire conditions, as initiated through execution of the step 213 of FIG. 6, is illustrated in FIG. 7, and begins its operations at a step 500. The routine proceeds to determine if any pending misfire requests are present at a step 502, such as by analyzing the status of a flag stored in controller memory. The flag is set when engine angular position synchronization is needed, such as when a cam fault condition has been detected, as will be described. If a misfire request is not pending, the routine of FIG. 7 is exited without inducing any misfire, by proceeding to a step 518 to return to the routine of FIG. 6. If a misfire request is pending, the routine moves to determine if the present engine cycle is the first during which the routine of FIG. 7 is executed. If so, fuel injector disable flags are initialized to zero corresponding to an enabled condition of all fuel injectors of the engine 10 (FIG. 1). After initializing the injector disable flags, the routine moves to the described step 518.

Returning to the step 504, if the present engine cycle is not the first during which the routine of FIG. 7 is executed, the routine moves to compare the counter INDEX to one. INDEX, in this embodiment, is maintained through the described operations of the routine of FIG. 6 to repeat every sixteen crank events. If INDEX equals one at the step 506, a misfire may be induced; otherwise, no misfire is induced. In this manner, when a misfire condition is requested, misfires are only sparingly induced over a test period. The frequency of induced misfires should be small enough to allow stable, reliable engine operation, yet should be large enough to be measurable for engine synchronization in accord with this invention. The number sixteen was selected in this embodiment as representing one of a number of misfire inducement frequency values.

If INDEX equals one at the step 506, the routine moves to a step 508 to determine which engine cylinder has been designated for misfire inducement. In general, cylinder pairs sharing a crank tooth should, in accord with this embodiment, be selected as candidates for misfire inducement, so that verification of the relationship between crank events and engine cylinder combustion events may be made. The cylinder pair should be selected as the pair having a least perceptible impact on engine operation, so that the engine position verification of the present embodiment will cause a minimum disruption in automotive vehicle operation. In this embodiment, either of cylinder two or three of the four cylinder engine 10 (FIG. 1) of this embodiment may be selected for misfire inducement. If cylinder two is selected for misfire inducement, the routine moves to a step 512 to set a disable injector two flag indicating a desired disabling of the fuel injector that, in the port fuel injection system of this embodiment, injects fuel to a cylinder two inlet area. Alternatively, if cylinder three is selected, the routine move to a step 510 to set a disable injector three flag indicating a desired disabling of the fuel injector that injects fuel to the cylinder three inlet area.

After setting the appropriate disable flag, the routine moves to a step 514 to carry out fuel injector control operations. Such operations include enabling fuel injector drivers 36 (FIG. 1) corresponding to each of the fuel injectors of the port fuel injection system applied to the engine 10 of FIG. 1. Only injectors having clear injector disable flags will be enabled at the step 514. The enabling of the fuel injector drivers 36 (FIG. 1) occurs once for each engine cycle. Then, at appropriate times during the engine cycle, each of the enabled drivers 36 (FIG. 1) will issue a fuel pulse to an injector of a corresponding cylinder. Any cylinder not having a clear injector disable flag will not receive a fuel pulse for that engine cycle which, under normal engine operations, will result in an engine misfire condition. After carrying out the injector control operations at the step 514, the described step 514 is executed to return to the operations of FIG. 6.

Figure 8A:
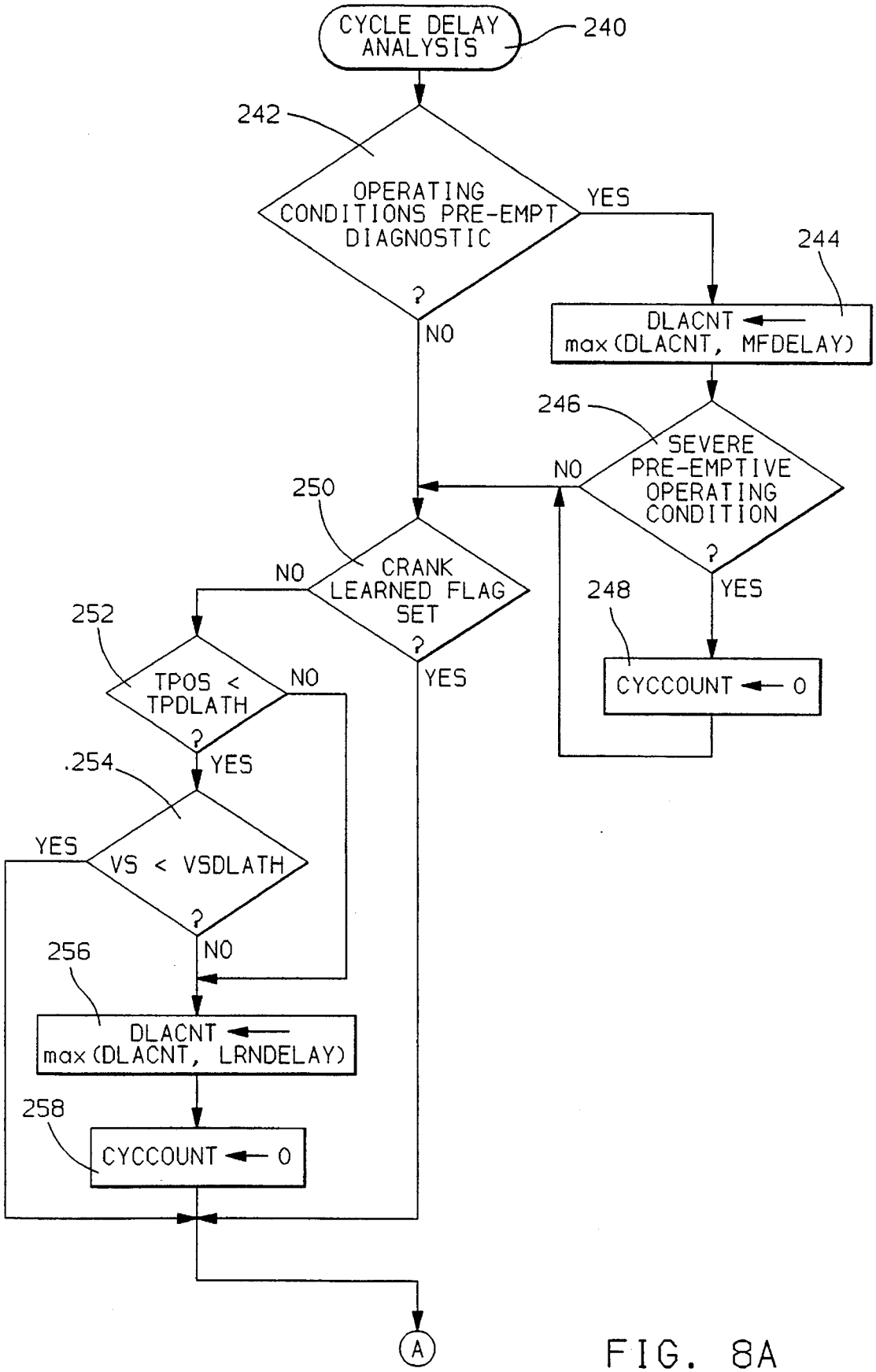
Figure 8B:
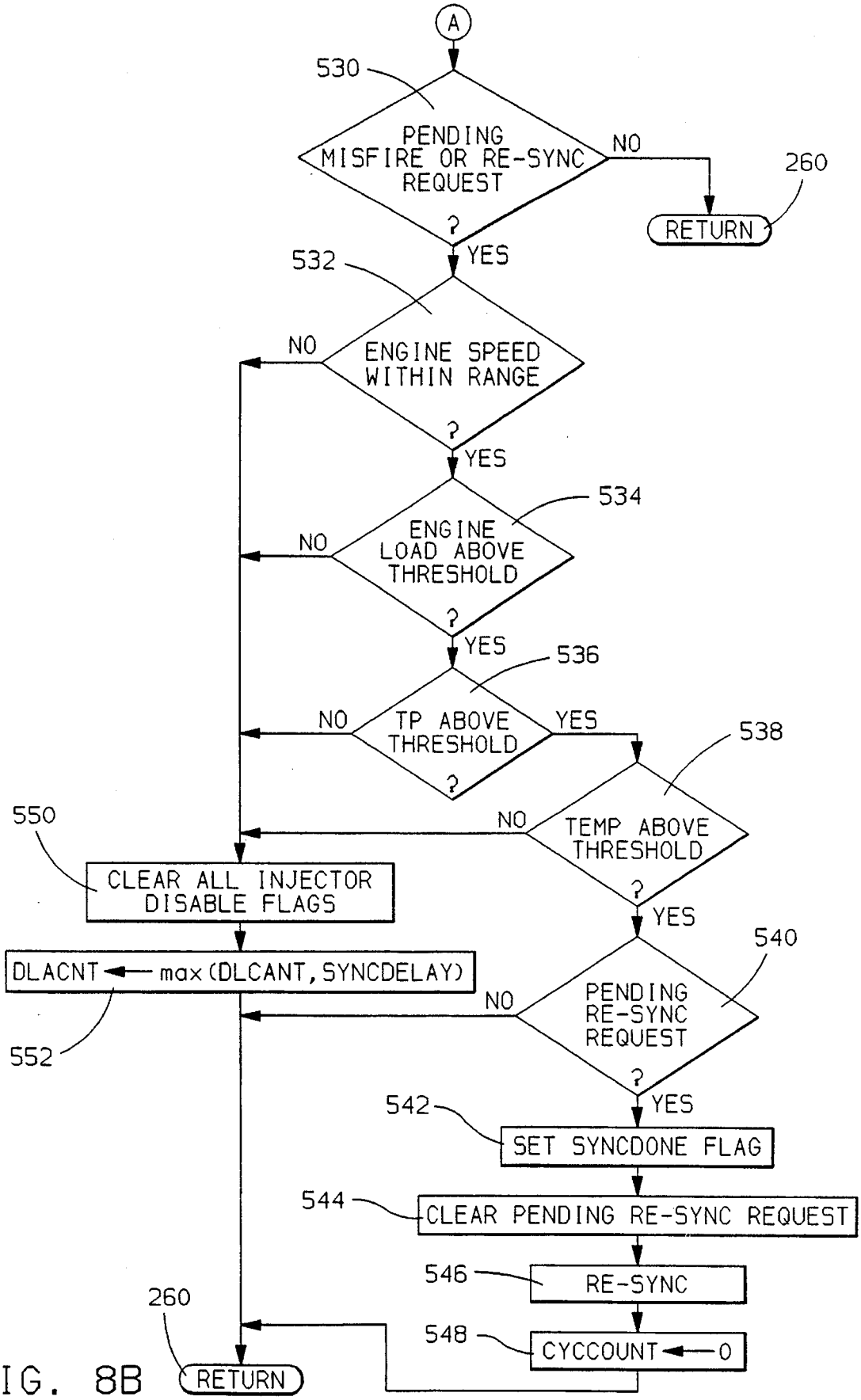

The cycle delay analysis routine is illustrated in FIGS. 8*a* and 8*b*, and is called at the described step 214 of the routine of FIG. 6. The cycle delay analysis routine generally monitors a set of engine and vehicle operating conditions that, if present, would interfere with the precision of the synchronization and misfire detection approach of this embodiment. If any such conditions are determined to be present in the cycle delay analysis routine, then synchronization or misfire detection is delayed by a predetermined time, wherein the predetermined time is set up to be sufficiently long to allow the condition to decay away, so that synchronization may then continue.

Specifically, when called at the step 214 of the routine of FIG. 6, the routine of FIGS. 8*a* and 8*b* is initiated, starting at a step 240 and proceeding to a step 242 to determine if any of a set of operating conditions are present that should preempt this diagnostic. Such operating conditions include any engine condition under which engine fueling is disabled, any temporary fuel shut-off during a significant engine deceleration, any significant change in engine throttle position above a relatively high threshold change in throttle position, or any conventional EGR diagnostic tests taking place wherein the EGR system may be operated in a diagnostic mode which may interfere with the accuracy of this misfire diagnostic.

If any of such operating conditions are present, the routine of FIG. 7 proceeds to a step 244 to set a delay value DLACNT to the larger of its current value or a predetermined delay value MFDELAY which may be set to five counts, representing five engine cycles of delay in this embodiment. After setting DLACNT at the step 244, the routine proceeds to a step 246 to determine if the present pre-emptive operating conditions are of a severe nature such that their presence would tend to skew significantly any previous data recorded under the current diagnostic test. Such severe operating conditions in this embodiment include a presence of negative engine output torque as may be detected in a conventional torque detection routine, not described herein.

If such negative engine output torque or other such conventionally-known severe operating condition is detected at the step 246, the routine proceeds to a step 248 to clear the cycle counter CYCCOUNT which monitors the number of cycles that have been tested during the current diagnostic test period. By resetting CYCCOUNT to zero at the step 248, a new test period will be initiated including a new set of 100 engine cycles, as will be described. After resetting CYCCOUNT at the step 248 or if no severe pre-emptive operating condition was detected at the step 246, or if no pre-emptive operating conditions were detected at the step 242, the routine proceeds to a step 250 to determine if a crank learned flag has been set.

The crank learned flag indicates whether the tooth error for the crankshaft of the engine 10 (FIG. 1) of this embodiment has been learned, such as was described in the routine of FIG. 5. If the crank learned flag is not set, the routine proceeds to steps 252–258, to determine if the engine is operating at idle, and to allow the present misfire diagnostic to continue if at idle despite a lack of crank tooth error learning.

Generally, the acceleration spike information relied on in this embodiment has associated with it a sensitivity to crank tooth error, as described. This sensitivity increases with increasing engine speed, wherein above a certain engine speed the acceleration spike signal to noise ratio has dropped to a level that obscures significantly misfire information. Returning to the FIG. 7, if the crank learned flag is not set at the step 250, the routine moves to a step 252 to compare engine throttle positions TPOS to a throttle position threshold TPDLATH. The throttle position threshold is set slightly higher than the zero throttle position so that a determination may be made at the step 252 as to whether throttle position is substantially at zero, indicating engine idle. If throttle position is determined to be substantially at zero at the step 252, which would be indicated by TPOS being less than TPDLATH, the routine proceeds to a step 254 to compare vehicle speed VS to a vehicle speed delay threshold VSDLATH which is set slightly higher than zero vehicle speed in this embodiment so that a determination may be made at the step 254 where as to whether the vehicle speed is substantially zero, indicating engine idle.

If vehicle speed is determined to be substantially zero at the step 254, as would be indicated by VS being less than VSDLATH, the engine is assumed to be at or substantially close to idle that the misfire diagnostic may continue despite the absence of crank tooth error learning. Accordingly, the routine proceeds to a step 530, to be described. Alternatively, if vehicle speed is not substantially zero as determined at the step 254 or if throttle position is not substantially zero as determined at the step 252, the engine is assumed to not be at or sufficiently near idle to allow the diagnostic to continue in the absence of crank tooth error learning, and thus the routine proceeds to a step 256 to reset the delay count DLACNT to the larger of its current value or to a learn delay value LRNDLAY set to five in this embodiment.

The routine then proceeds to a step 258 to reset the cycle counter CYCCOUNT to zero to begin a new test period of 100 engine cycles. Accordingly, if the crank tooth error has not been learned and, at any time during a diagnostic test, the engine deviates significantly from idle, the test will be discontinued, and not restarred until after a delay time. Returning to the step 258, after resetting CYCCOUNT to zero, the routine of FIG. 7 proceeds to steps 530–552, to determine whether engine operating parameters indicate that the engine is operating in a sufficiently stable region that misfires may be induced or that a re-synchronization of crank information may be made without perceptibly disturbing engine operation. For example, if the engine is operating at a low engine speed or load, it may be more sensitive to misfire conditions, which may lead to perceptible changes in engine torque, engine speed, and may even lead to an engine stall condition. In such cases, misfire inducement will be delayed until the engine is no longer operating in such sensitive regions. Specifically, such conditions are analyzed by first determining whether a misfire request or a synchronization request is pending, such as may be requested in accord with yet to be described operations of the present embodiment. If neither request is pending, analysis of the conditions indicating engine sensitivity is not necessary, and the routine moves to a step 260, to return to the routine of FIG. 6.

If either request is pending however, the routine moves to a step 532, to determine whether engine speed is within a range corresponding to a robust engine operating level. Such engine speed range is calibrated in the present embodiment as being between 650 and 6500 r.p.m. If the engine speed is within the range, then the engine load, or the engine inlet air consumption rate, which may be indicated by engine speed and intake manifold pressure or as may be indicated by engine inlet mass airflow, is compared to a load threshold value calibrated as about zero load in this embodiment. If the load is above the load threshold, then the position of the engine intake air valve as indicated by signal TP is compared to a TP threshold value at the step 536. The TP threshold is set to a very low value, such as corresponding to a substantially closed valve. IF the valve position is above the TP threshold value, engine coolant temperature TEMP is compared, at a step 538, to a temperature threshold value, calibrated in this embodiment to about −7 degrees Celsius. If coolant temperature is above the temperature threshold, then the misfire or synchronization operations may take place as the engine is sufficiently warmed up and at a sufficiently high engine operating point to be insensitive to induced misfires or to synchronization. The routine moves to continue misfire or synchronization operations by moving to a step 540 to determine if a re-synchronization request is pending. If such a request is pending, the routine sets the SYNCDONE flag at a step 542 to indicate that re-synchronization has been carried out, and then clears the pending request for re-synchronization at a step 544, and the executes a re-synchronization routine at a step 546, by executing the steps of FIG. 9, to be described. After such routine is executed at the step 546, a step 548 is executed to clear the cycle counter CYCCOUNT, to reset the misfire test used in the present embodiment. Next, or if no re-synchronization request was predetermined to be pending at the step 540, the routine moves to the described step 260, to return to the routine of FIG. 6.

Returning to the steps 532–538, if any of the engine parameters of engine speed, load, inlet air valve position, or coolant temperature are not within the calibrated ranges or above the calibrated threshold values, misfires and re-synchronization operations are delayed by clearing all injector disable flags to enable all engine fuel injectors at the step 550, and then by resetting the delay counter DLACNT to the larger of the current DLACNT value or the fixed value SYNCDELAY, which is calibrated to about 2 in this embodiment, corresponding to a delay of about 2 engine cycles before misfire inducement or engine re-synchronization will again be attempted. After resetting DLACNT at the step 552, the routine moves to the described step 260.

Figure 9:
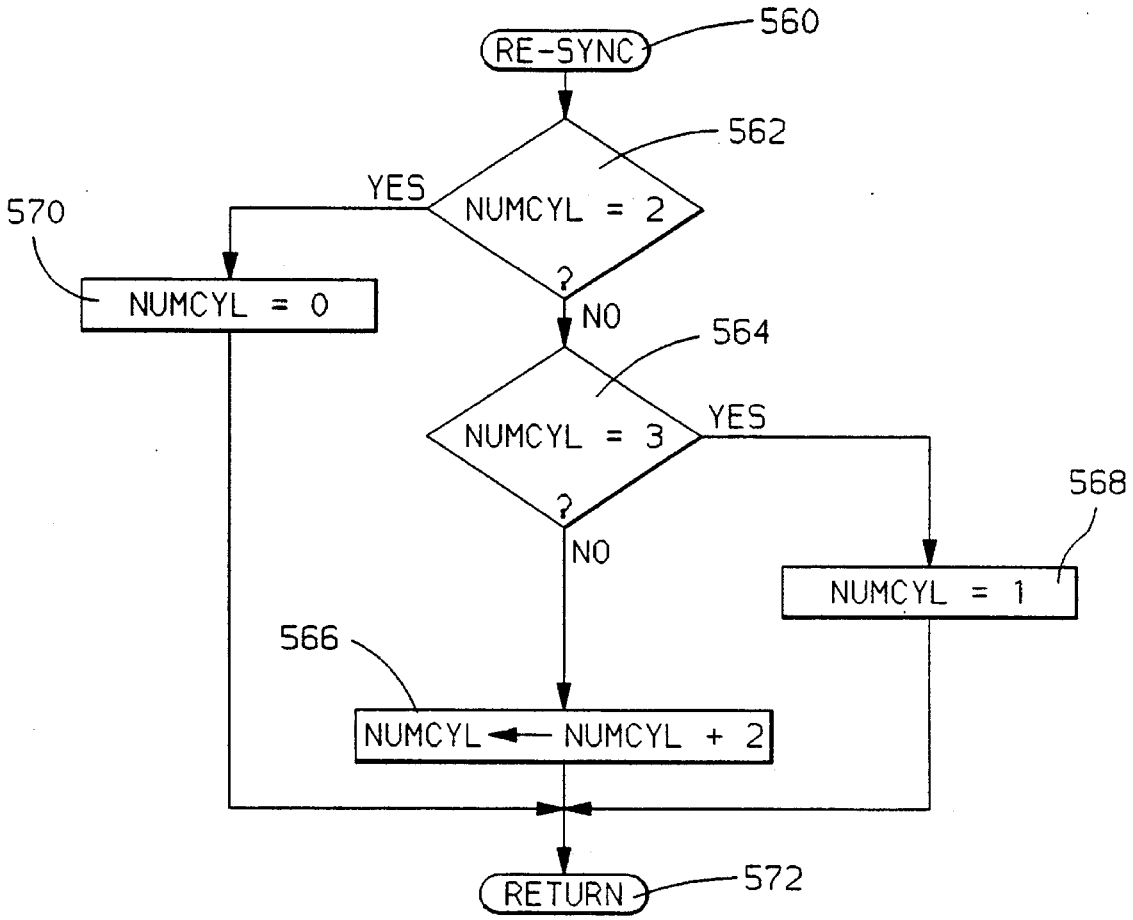

Referring to FIG. 9, the operations used to re-synchronize the engine are illustrated, as executed following execution of the step 546 of FIG. 8*b* when the engine is out of synchronization and the correct synchronization is known and is to be substituted for the incorrect substitution. Re-synchronization is required in this embodiment if, through execution of the routines of this embodiment, the engine is determined to be out of synchronization, which occurs if a crankshaft tooth or notch is determined to be aligned to the wrong one of the corresponding pair of engine cylinders to which it corresponds. In other words, there are n/2 teeth or notches in the crankshaft of the four cycle, n cylinder engine to which this invention is applied. Each tooth or notch passes the crankshaft position sensor twice for each engine cycle. Each tooth or notch is mapped to two engine cylinders. When a crank event occurs for that tooth, one of the two cylinders is in its compression stroke and the other is in its exhaust stroke—although the crank tooth or notch information cannot discern which the two cylinders is in which stroke. The camshaft position sensor provides information that may be used to discern which cylinder is in which stroke. If the camshaft position sensor information is determined to be faulty, the synchronization approach of the present invention is used. If the operations of the present invention determine that the engine is out of synchronization, which is characterized by the crank event being associated with the wrong stroke of the corresponding pair of cylinders, re-synchronization is provided, in this four cylinder embodiment, through the routine of FIG. 9, by increasing the cylinder pointer NUMCYL by two, to point to the correct cylinder for each crank event. specifically, if NUMCYL is two at a first step 562, it is set to 0 at the step 570. If it is not two, but is three as determined at the step 564 following the step 562, then it is set to one at the step 568. If it is not two or three, than it may be re-synchronized simply by adding two to it at the step 566 as no overflow will need to be addressed by such addition. After the steps 570, 568 or 566, the routine of FIG. 9 moves to a step 572 to return to the routine from which it was called.

Figure 10A:
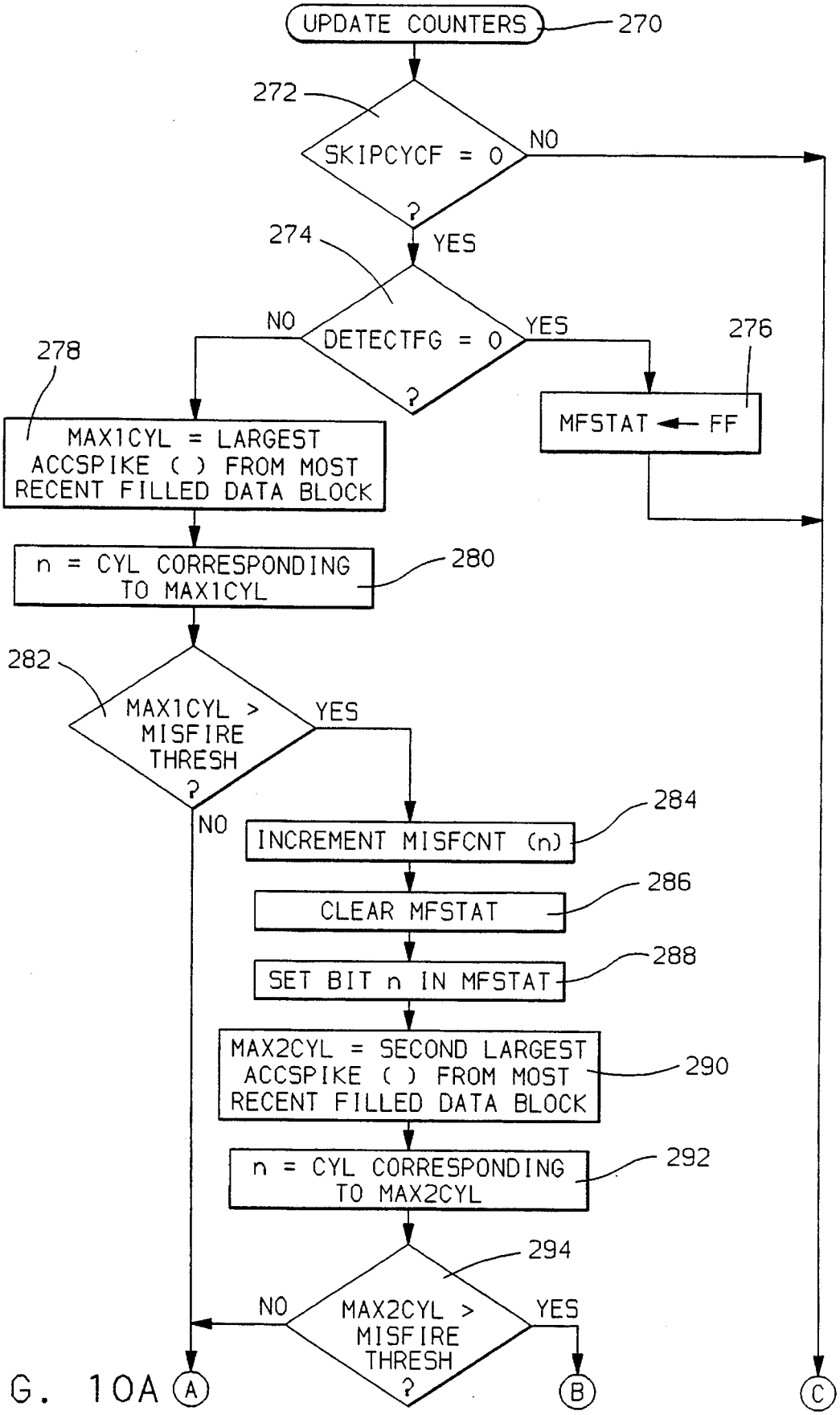
Figure 10B:
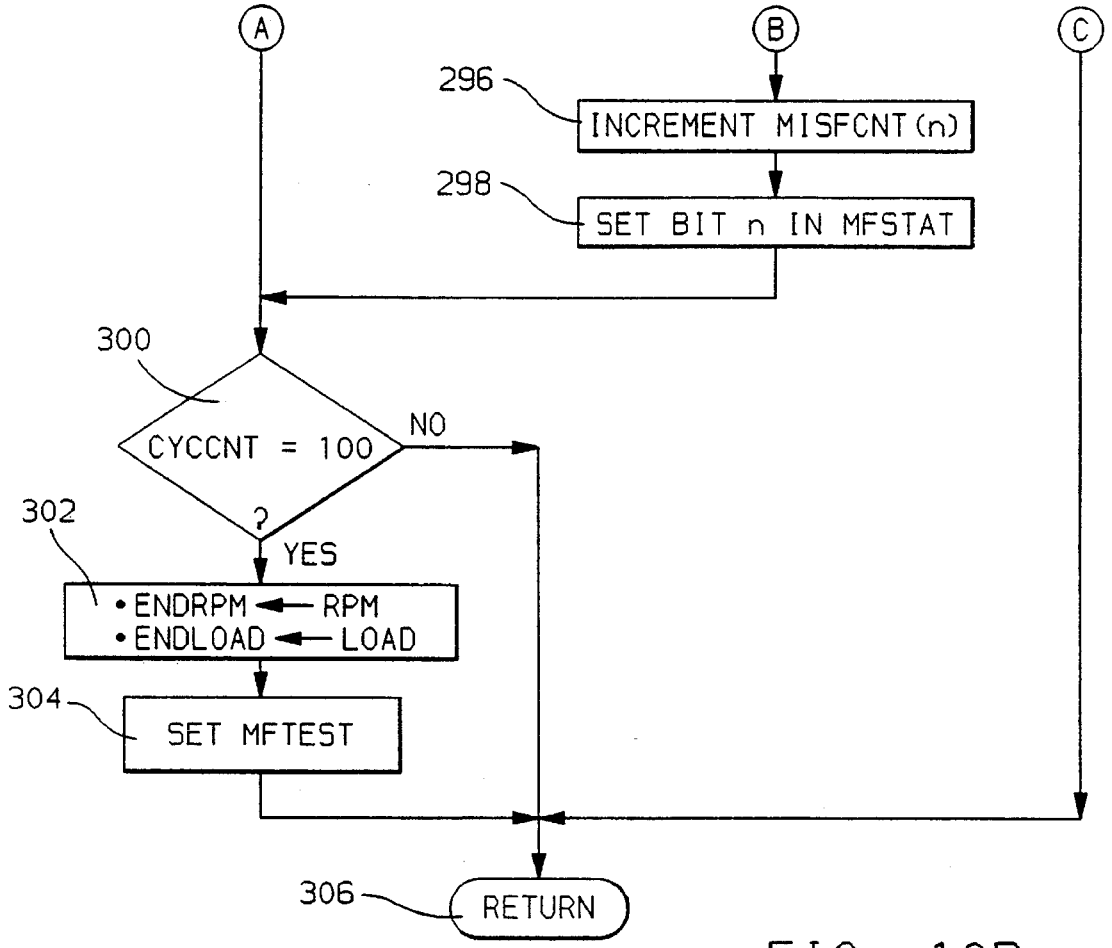

Referring to FIGS. 10*a* and 10*b*, the routine to update misfire counters is illustrated, as called at the described step 224 of the routine of FIG. 6. When called, the routine of FIG. 10*a* is initiated starting at a step 270 and proceeds to a step 272 to determine if a skip cycle flag is set. If the skip cycle flag is set, indicating that conditions are not appropriate to update the misfire counters, the routine proceeds to a step 306 where it is directed to return to the step 224 of the routine of FIG. 6.

If the skip cycle flag is not set at the step 272, the routine proceeds with the misfire counter update by moving to a step 274 to determine if a flag DETECTFG is clear. If this flag is clear at the step 274, it is assumed that misfires under the current engine operating conditions are not reliably detectable and the routine proceeds to a step 276 to set a misfire status word to hexadecimal value FF or all ones in an eight bit format, to indicate the detectability difficulty, and then proceeds to the described step 306.

However, if the detect flag is not clear at the step 274, the routine proceeds to a step 278 to determine a maximum acceleration spike value from the most recent filled block of four values in the sixteen entry array of acceleration spike values. The blocks contain four consecutive acceleration spike values. The first block contains the first four entries in the sixteen entry array, the second block contains the fifth through eighth entries in the sixteen entry array, etc. By way of explanation, the last block in the array, namely the thirteenth through sixteenth entries in the array, will be analyzed in this routine of FIGS. 8*a* and 8*b* after the array is filled and begins storing a new array over the old array, starting at the first block.

The maximum value from the set of four values in the most recent filled block indicates the cylinder having the most significant deceleration and subsequent acceleration i.e. acceleration spike, over that block which represents four consecutive cylinder events making up an engine cycle. The maximum value is selected at the step 278 for comparison to the misfire threshold value as determined at a step 372, to be described, to determine if the acceleration spike is sufficiently large to indicate an engine misfire.

Specifically, at the step 278, MAX1CYL is selected as the largest acceleration spike value for the most recent filled block of acceleration spike values. The routine then proceeds to a step 280 to set the value n to the cylinder number corresponding to that found largest or maximum acceleration spike value. The routine then proceeds to a step 282 to compare MAX1CYL to the misfire threshold value determined at a step 372 of the routine of FIG. 12, to be described.

If the maximum acceleration spike value exceeds the misfire threshold value, a misfire is assumed to have occurred for the nth cylinder, and the routine proceeds to a step 284 to increment a misfire counter MISFCNT(n) corresponding to that nth cylinder. Accordingly, any misfiring cylinder of the engine will have a corresponding count in accord with the present diagnostic of the number of misfires that have occurred over a test period, such as over the 100 engine cycle test period of the present embodiment. After incrementing the appropriate misfire counter corresponding to the cylinder n at the step 284, the routine proceeds to a step 286 to clear the status word MFSTAT which indicates most recent misfiring cylinder or cylinders.

The routine then proceeds to a step 288 to set the nth bit in MFSTAT, indicating that a misfire has been detected for the nth cylinder during the current crank event interrupt service routine, and next advances to a step 290 to determine the second highest acceleration spike value MAX2CYL over the most recent filled block of values in the sixteen entry array. The cylinder corresponding to that second highest value is then stored as n at a next step 292, and the second highest value MAX2CYL is next compared at a step 294 to the misfire threshold value determined through the step 372 of the routine of FIG. 12, to be described.

If MAX2CYL exceeds the misfire threshold, then the it is assumed the cylinder n also misfired, and the routine moves to a step 296 to increment a counter MISFCNT(n) which holds a count of the number of misfires in the cylinder n over the present test period, such as the one hundred cycle test period of the present embodiment. Next, the bit n corresponding to the misfiring cylinder n is set in MFSTAT at the step 298. In this manner, the present embodiment of the invention is capable of detecting and recording up to two misfires per engine cycle. Accordingly, two misfire counters will have been incremented through the present execution of the routine of FIGS. 10*a* and 10*b* and two bits will be set in the misfire status word MFSTAT, one bit representing the cylinder corresponding to the highest acceleration spike value over the selected four spike values and the other bit representing the cylinder corresponding to the second highest acceleration spike value over the selected four spike values.

After setting bit n in MFSTAT at the step 298, or if the MAX1CYL did not exceed the misfire threshold at the step 282, or if MAX2CYL did not exceed the misfire threshold at the step 294, the routine proceeds to a step 300 to determine if 100 engine cycles of data have been analyzed for the current diagnostic test. Specifically, at the step 300, CYCCNT is compared to 100. If CYCCNT exceeds 100, the current test period is complete and the routine proceeds to a step 302 to store engine speed RPM as ENDRPM, and to store engine load LOAD as end load ENDLOAD, for use later in the present misfire diagnostic. The routine then proceeds to a step 304 to set a flag MFTEST, indicating that the current test is complete and the accumulated misfire data may now be analyzed. Next, or if CYCCNT was not set to 100 at step 300, the routine proceeds to the described step 306.

Figure 11:
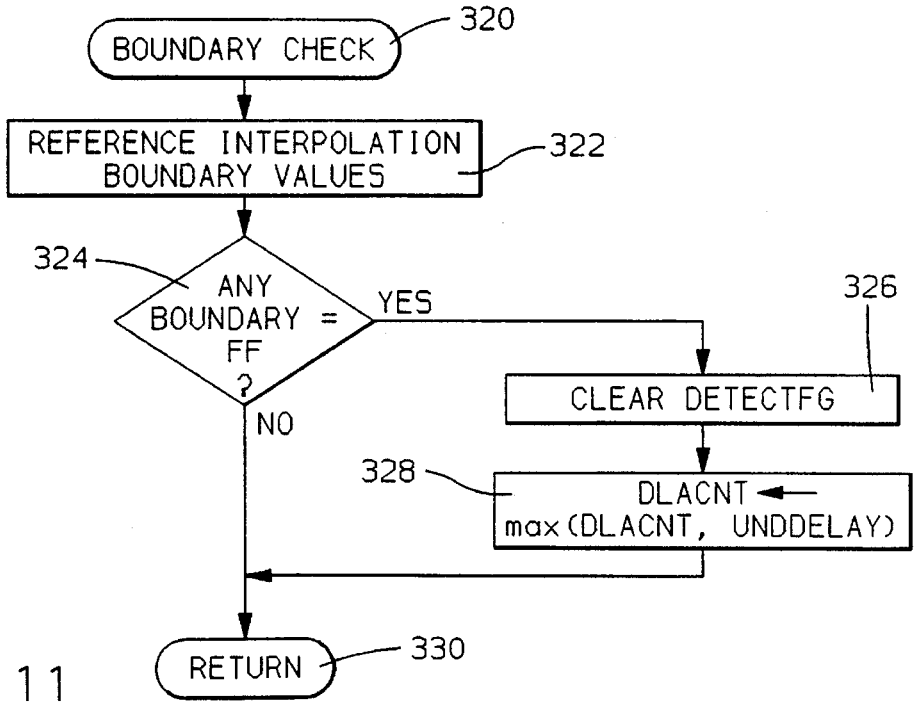

Referring to FIG. 11, a boundary check routine is illustrated, as is called at the described step 226 of FIG. 6. Generally, the boundary check routine of FIG. 11 establishes four boundary values around the misfire threshold value, as was described in FIG. 10*a* at steps 282 and 294, to which the acceleration spike values are compared in the misfire determination of the routine of FIGS. 10*a* and 10*b*. Specifically, the routine of FIG. 11 is entered at a step 320, and proceeds to a step 322 to reference misfire threshold value boundary values between which the misfire threshold value will be determined.

Figure 16:
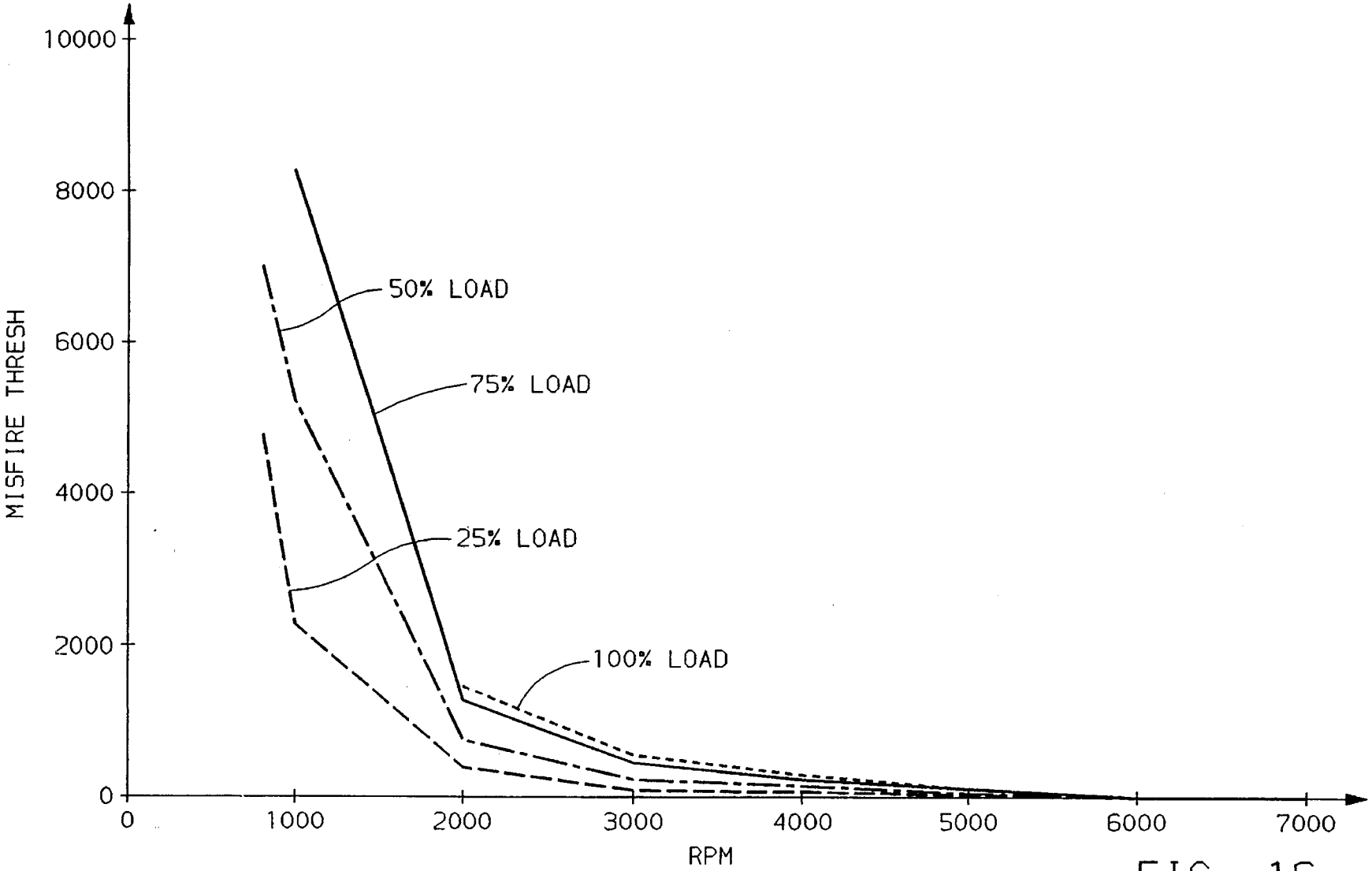
FIG. 16 illustrates relationships between engine parameters and a misfire threshold value for use in the preferred embodiment.

In this embodiment, the misfire threshold value is referenced from a predetermined lookup table of values stored as a function of engine speed and engine load. The table values may be determined through a conventional calibration process by determining, for engine speed and load, the magnitude of an acceleration spike value above which a misfire exists in an engine cylinder. Then, at the step 322, the misfire threshold values in the table for the stored table values closest to the present engine speed and load are referenced for interpolation therebetween to determine a present misfire threshold value. For example, the conventional calibration may produce the relationships between engine speed and load and misfire threshold values MISFIRE THRESH illustrated in FIG. 16, which corresponds to the relationships applied in the misfire diagnostic used in this embodiment. The relationships represented in the FIG. 16 may be incorporated into a conventional lookup table by storing the engine speed RPM and engine load together with the corresponding MISFIRE THRESH as referenced from the FIG. 16 into the table as groups of values. Sets of the three values should be selected and stored in the table in sufficient number so that MISFIRE THRESH values are available representing the entire range of possible engine speed and load values.

After referencing the table values at the step 322, the routine moves to a step 324 to determine if any of the referenced table values are set to hexadecimal value FF, indicating that the vehicle is currently operating in or next to a calibrated undetectable engine operating region. A region is undetectable if reliable misfire information cannot be established through the described calibration process for the corresponding engine speed and load, wherein a value equal to hexadecimal FF (decimal 255) will be stored in the lookup table to indicate the undetectable region. If an FF is referenced from the table for the current engine speed and load, the routine moves to a step 326 to clear DETECTFG, indicating the undetectable region. The routine then sets a delay at a step 328, to the larger to the current DLACNT value, or an undetectable region delay value UNDDELAY, which is set to approximately four in this embodiment. Next, or if none of the referenced boundary values indicated an undetectable region at the step 324, the routine moves to a step 330 and returns to the step 226 of FIG. 6.

Figure 12:
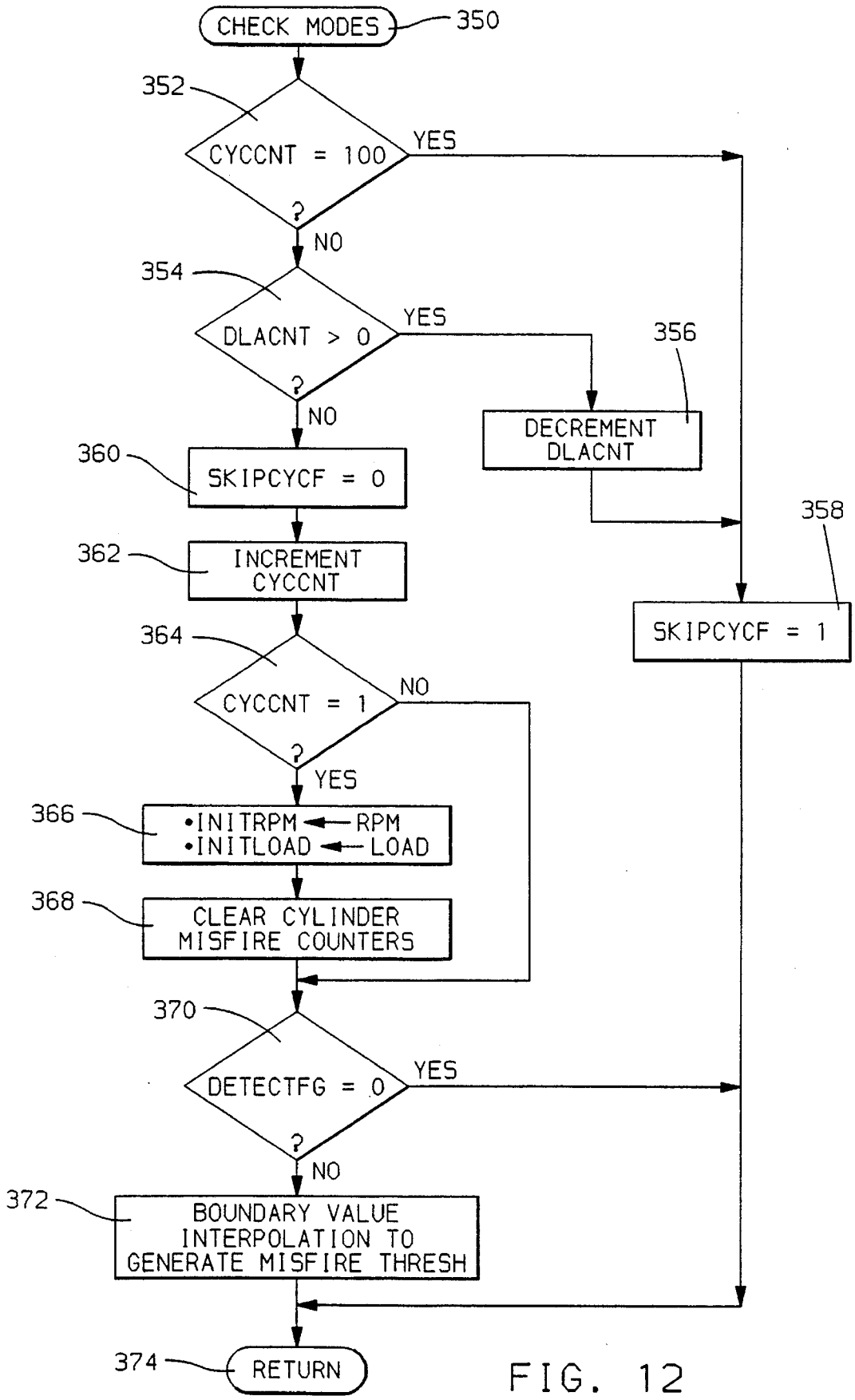

Referring to FIG. 12, a routine to check modes as called at the step 228 of FIG. 6 is illustrated, which is initiated at a step 350 when called, and proceeds to step 352 to determine if the cycle counter CYCCNT is at 100 indicating the end of the current misfire test period. If CYCCNT is equal to 100 at the step 352, the current test period is complete and the routine proceeds to a step 358 to set flag SKIPCYCF to one, and then proceeds to step 374 of the routine of FIG. 12 to return to the routine of FIG. 6, as the modes needs not be checked at the end of the misfire test period.

Alternatively at the step 352, if the cycle count CYCCNT is not equal to 100, the routine of FIG. 12 proceeds to a step 354 to determine if the delay counter DLACNT is above zero. If DLACNT is above zero, then a delay that has been established either through the steps of the routine of FIGS. 8*a* and 8*b* or the steps of the routine of FIG. 11 is not yet terminated such that further delay is needed before this misfire diagnostic should continue. In such a case, the routine of FIG. 12 proceeds to a step 356 to decrement the delay counter DLACNT indicating another engine cycle has occurred during the pending delay period, and then proceeds to the described step 358.

Returning to the step 354, if the delay counter is not greater than zero, indicating that any delay period previously established has elapsed, the routine proceeds to a step 360 to set the skip cycle flag SKIPCYCF to zero and then proceeds to increment the cycle counter CYCCNT at a step 362 indicating another engine cycle has occurred during the current misfire diagnostic test period. The routine of FIG. 12 then proceeds to a step 364 to determine if cycle count is set to one, indicating that the current engine cycle is the first in the test period of 100 engine cycles of this embodiment. If cycle counter is equal to one, then some initialization steps are required in this embodiment including the steps described at step 366 of storing current engine speed RPM as INITRPM in computer memory for later use, and storing current engine load LOAD as INITLOAD in computer memory for later use in this embodiment.

The next step executed for initialization is to clear all misfire counters at a step 368, such as the counters that log any misfires in each of the engine cylinders during the 100 cycle test period of this embodiment. Next, or if the cycle counter was determined to not be set to one at the step 364, the routine proceeds to a step 370 to determine if the detect flag DETECTFG is clear. The detect flag, as was set at the conditional step 326 of FIG. 9, indicates whether the current engine operating region is one in which the misfires of the engine are determined, such as though a calibration process, to be detectable. If the detect flag is clear at the step 370, the misfires are assumed to not be currently detectable, and the routine proceeds to the described step 374.

Alternatively, if the detect flag is set to one at the step 370, the routine proceeds to a step 372 to interpolate between the values referenced in the routine of FIG. 11 to generate a misfire threshold value, such as by employing well-known interpolation techniques. After generating the misfire threshold value at the step 372, the routine of FIG. 12 proceeds to the described step 374.

Figure 13:
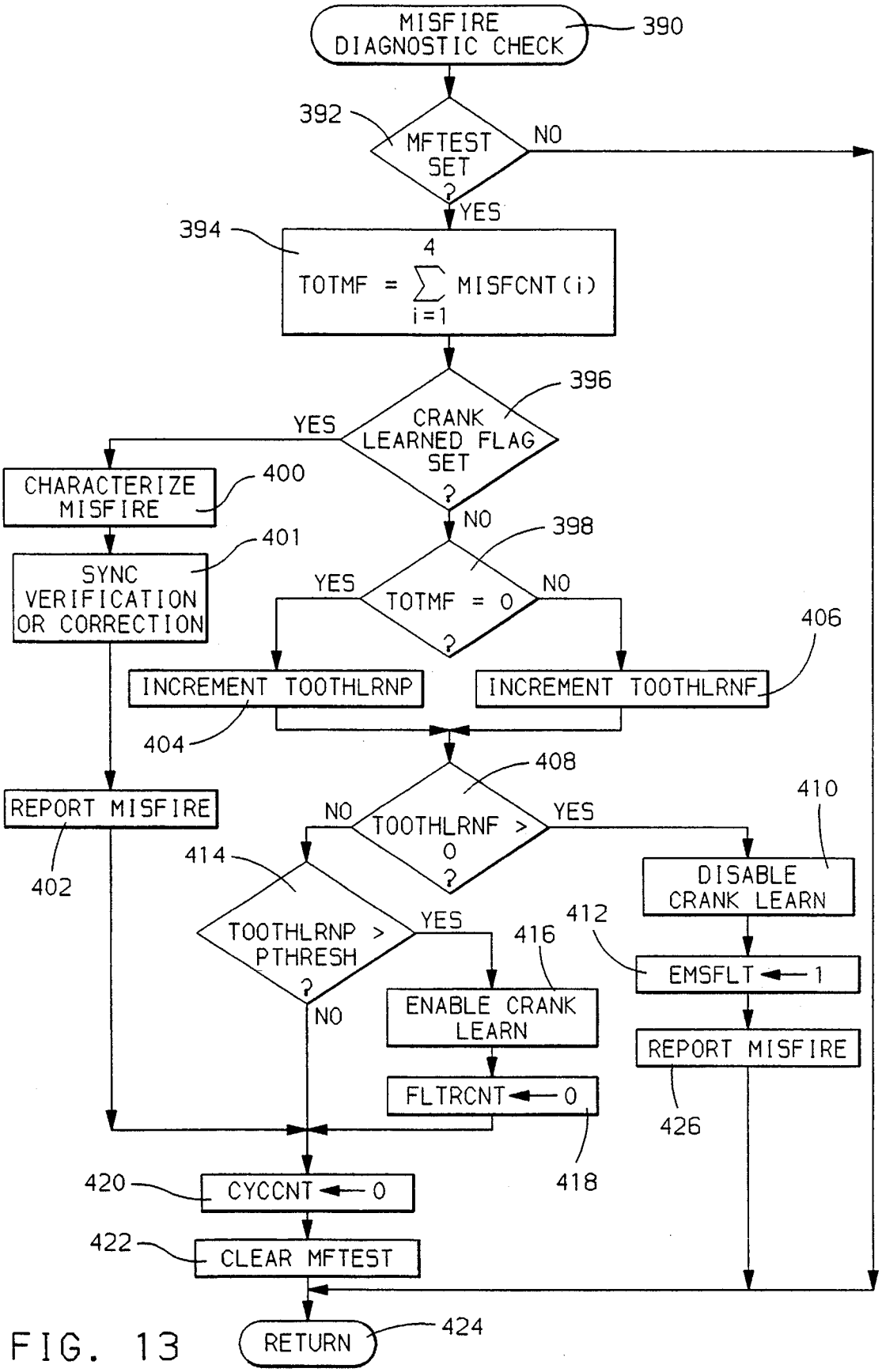

Referring to FIG. 13, a misfire diagnostic check routine is illustrated, such as may be called periodically while the engine is running, for example every 10 milliseconds of engine operation. A conventional time-based controller interrupt may be established so that upon occurrence of the interrupt, the controller may execute the routine of FIG. 13. The routine of FIG. 13 generally carries out a diagnostic check at the end of every test period of the present embodiment, to summarize and categorize misfire diagnostic test results for that test period, and to verify engine synchronization in accord with this invention.

Specifically, upon occurrence of the time-based controller interrupt, the routine of FIG. 13 is executed starting at a step 390 and proceeding to a step 392 at which the misfire test flag is analyzed. If the flag is not set, indicating the current test period is not complete, the routine proceeds to a step 424 to return to any prior controller operations that were ongoing at the time of the current time-based interrupt that evoked the routine of FIG. 13.

Alternatively at the step 392, if MFTEST is set, the routine proceeds to a step 392 to sum the misfires counted for each of the four cylinders of the engine of this embodiment from the four corresponding misfire counters. The sum of all counted misfires for all of the four cylinders is stored as TOTMF. After summing the misfires at the step 394, the routine proceeds to a step 396 to determine if the crank learn flag has been set. If so, the routine is prepared to go on and characterize the summed up misfire information. A routine to characterize misfire information is next called at a step 400, wherein the controller is directed to carry out the operations illustrated in FIG. 14, to be described. After such operations are complete, the controller returns to FIG. 13 and proceeds to a step 401 to call a routine, illustrated in FIGS. 15*a* and 15*b*, to be described, to verify or correct engine synchronization information using the characterized misfire information in accord with this invention. The controller carries out the steps illustrated in FIGS. 15*a* and 15*b* and then returns to the operations of FIG. 13, and proceeds to a step 402, to report any misfire information that may have been characterized at the step 400. Specifically, the misfire reporting may take place in a number of conventionally known reporting formats. For example, information on misfires may be stored in controller non-volatile memory, or may be indicated via a conventional display device, for example one located on the instrument panel of the vehicle, to alert the vehicle operator of the misfire status.

The reported misfire at the step 402 may lB include information on the misfiring cylinders and the degree or character of the misfires detected. Further, any CAM error that was corrected through execution of the routine of FIGS. 15*a* and 15*b* may be reported. The inventors intend that the misfire reporting at the step 402 may take place in accord with conventional misfire or engine diagnostic reporting approaches. After reporting the misfire information at the step 402, the routine proceeds to a step 420, to be described. Returning to the step 396, if the crank learn flag is not set, indicating that the crank tooth error information has not been incorporated into the misfire detection information of the most recent test cycle, then any available misfire diagnostic information pertains to idle misfire, as only idle misfire diagnostics are carried out without crank tooth error information. In other words, as described in the routine of FIGS. 8*a* and 8*b*, the misfire diagnostic of this embodiment does not operate without crank tooth error information unless at or close to an engine idle condition at which reliable diagnostic information is available without tooth error correction.

Returning to FIG. 13, idle misfire information is analyzed by moving from the step 396 to a step 398, to determine TOTMF is equal to zero indicating no idle misfires recorded over the test period of 100 engine cycles. IF TOTMF equals zero, the routine moves to a step 404 to increment a counter TOOTHLRNP, and otherwise moves to a step 406 to increment a counter TOOTHLRNF if TOTMF is greater than zero. After incrementing either TOOTHLRNP or TOOTHLRNF, the routine moves to a step 408, to determine if TOOTHLRNF is greater than zero, indicating that idle misfires have been detected. If TOOTHLRNF is greater than zero, the routine moves to a step 410, to disable crank learning, as such learning should not take place during any misfire condition.

The routine next moves to a step 412 to set a misfire indicator flag EMSFLT to one, indicating a misfire has occurred the severity of which may cause a measurable increase in engine emissions. The flag EMSFLT may be stored in controller non-volatile memory. The routine next proceeds to a step 426 to report the idle misfire, such as in the manner described at the step 402, and then moves to the described step 424.

Returning to the step 408, if TOOTHLRNF is not greater than zero, the routine moves to a step 414, to determine if TOOTHLRNP is greater than a predetermined threshold value PTHRESH, set to four in this embodiment representing four 100 cycle tests or equivalently 800 engine revolutions. If TOOTHLRNP is greater than PTHRESH, a sufficient number test periods were completed at idle without a misfire that the tooth learning of the present embodiment may be carried out. Accordingly, the routine moves to a step 416 to enable crank learning, such as by setting an appropriate flag in controller memory, and then moves to a step 418 to clear FLTRCNT, the count of the number of TUTHFCTR values that will go into the learned correction value, as described in FIG. 5.

Next, or if TOOTHLRNP was not greater than PTHRESH at the step 414, the routine moves to a step 420 to reset CYCCNT to zero, to prepare for the next 100 cycle test period, and then moves to a step 422 to clear the flag MFTEST, which will not be set until the end of the next test period. The routine then moves the described step 424.

Figure 14:
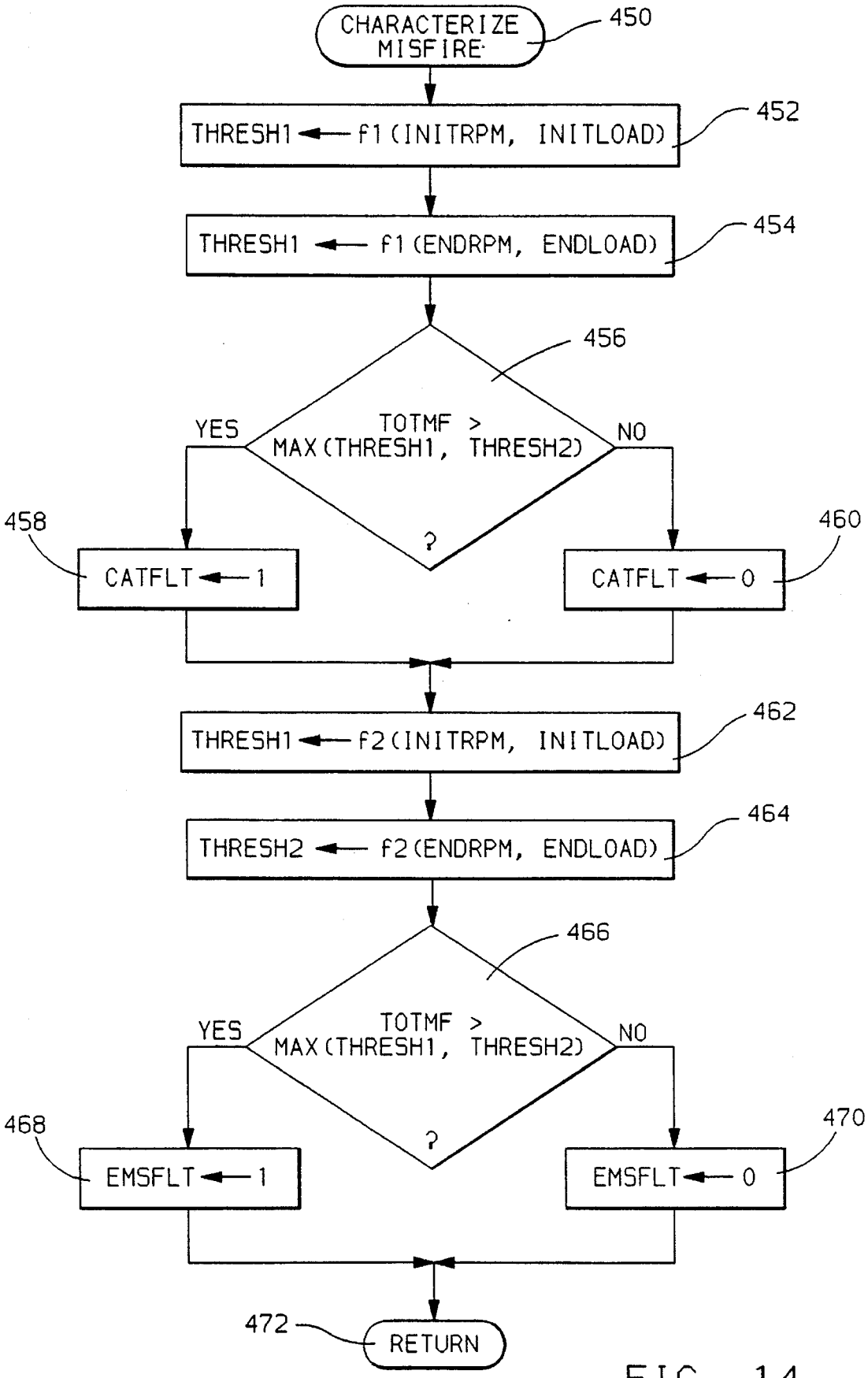

The routine to characterize misfires is called at the step 400 of the routine of FIG. 13, is illustrated in the FIG. 14, and is entered upon being called at a step 450. The routine moves first to steps 452–460, to determine the impact of any counted misfires on the performance or health of a conventional catalytic converter (not shown) through which the emissions of engine 10 (FIG. 1) may pass. Specifically, the routine moves to a step 452 to reference THRESH1, a catalytic converter damage misfire count threshold value, as a function fl of INITRPM, and INITLOAD, the speed and load respectively of the engine 10 (FIG. 1) at the start of the most recent test period. Values for THRESH1 may be stored for engine speed-load pairs in a conventional lookup table, and referenced therefrom by a generally-known interpolation routine between the two speed-load pairs surrounding INITRPM and INITLOAD.

Individual THRESH1 values may be arrived at by determining a total misfire count of all cylinders over a 100 engine cycle test period that would potentially cause substantial damage to a catalytic converter through which the engine exhaust gas passes. The total count may be determined as a function engine speed and load by setting the speed and load to each of a series of predetermined values and, at each setting, determining the total count needed to potentially cause substantial damage to the catalytic converter, such as damage that would significantly reduce the performance of life of the converter.

Returning to FIG. 14, after referencing THRESH1, the routine moves to a step 454 to reference THRESH2, a second catalytic converter damage misfire count threshold value, using the conventional lookup table described for referencing THRESH1, and using a second lookup speed-load pair, namely ENDRPM and ENDLOAD, the speed and load of the engine measured at the engine of the most recent test period. Accordingly, two threshold values for determining the impact of the count of any diagnosed misfires of the catalytic converter are provided. The inventors intend that a variety of different determinations may be substituted for those of the present embodiment for determining the impact on the converter. The use of speed-load pairs at the beginning and end of the test period are preferred due to their simplicity and their rough representation of the speed and load over the test period.

After determining THRESH1 and THRESH2, the routine move to a step 456, to compare the larger of the two thresholds to TOTMF. If TOTMF exceeds the larger of the two thresholds at the step 456, a catalytic converter impact misfire condition is assumed to be present, and the routine moves to a step 458, to indicate the condition by setting a catalytic converter fault flag CATFLT to one. Alternatively, if TOTMF does not exceed the larger of the two, the routine moves to a step 460, to clear CATFLT. After setting or clearing CATFLT, the routine moves to steps 462–470, to determine the potential emissions impact of any counted misfires.

Specifically, the routine moves to a step 462, to reference an emissions impact threshold value, called THRESH1 for simplicity, as a function f2 of , INITRPM, and INITLOAD, the speed and load respectively of the engine 10 (FIG. 1) at the start of the most recent test period. Values for THRESH1 may be stored for engine speed-load pairs in a conventional lookup table, and referenced therefrom by a generally-known interpolation routine between the two speed-load pairs surrounding INITRPM and INITLOAD.

Individual THRESH1 values may be arrived at by determining a total misfire count of all cylinders over a 100 engine cycle test period that would potentially cause a substantial increase in engine emissions. The total count may be determined as a function of engine speed and load by setting the speed and load to each of a series of predetermined values and, at each setting, determining the total count needed to potentially cause a substantial increase in engine emissions.

Returning to FIG. 14, after referencing THRESH1, the routine moves to a step 464 to reference THRESH2, a second emissions misfire count threshold value, using the conventional lookup table described for referencing THRESH1, and using a second lookup speed-load pair, namely ENDRPM and ENDLOAD, the speed and load of the engine measured at the engine of the most recent test period. Accordingly, two threshold values for determining the impact of the count of any diagnosed misfires on engine emissions are provided. The inventors intend that a variety of different determinations may be substituted for those of the present embodiment for determining the impact on emissions. The use of speed-load pairs at the beginning and end of the test period are preferred due to their simplicity and their rough representation of the speed and load over the test period.

After determining THRESH1 and THRESH2, the routine moves to a step 466, to compare the larger of the two thresholds to TOTMF. If TOTMF exceeds the larger of the two thresholds, a misfire condition is assumed to have been detected that significantly impacts engine emissions, and the routine indicates the condition by setting emissions fault flag EMSFLT to one at the step 468. Otherwise, if TOTMF is not greater that the larger of the two thresholds at the step 46, the routine clears the emissions fault flag EMSFLT at the step 470. After either clearing or setting the flag EMSFLT, the routine of FIG. 14 proceeds to a step 472, to return to the step 400 of the routine of FIG. 13 from which it was called.

Figure 15A:
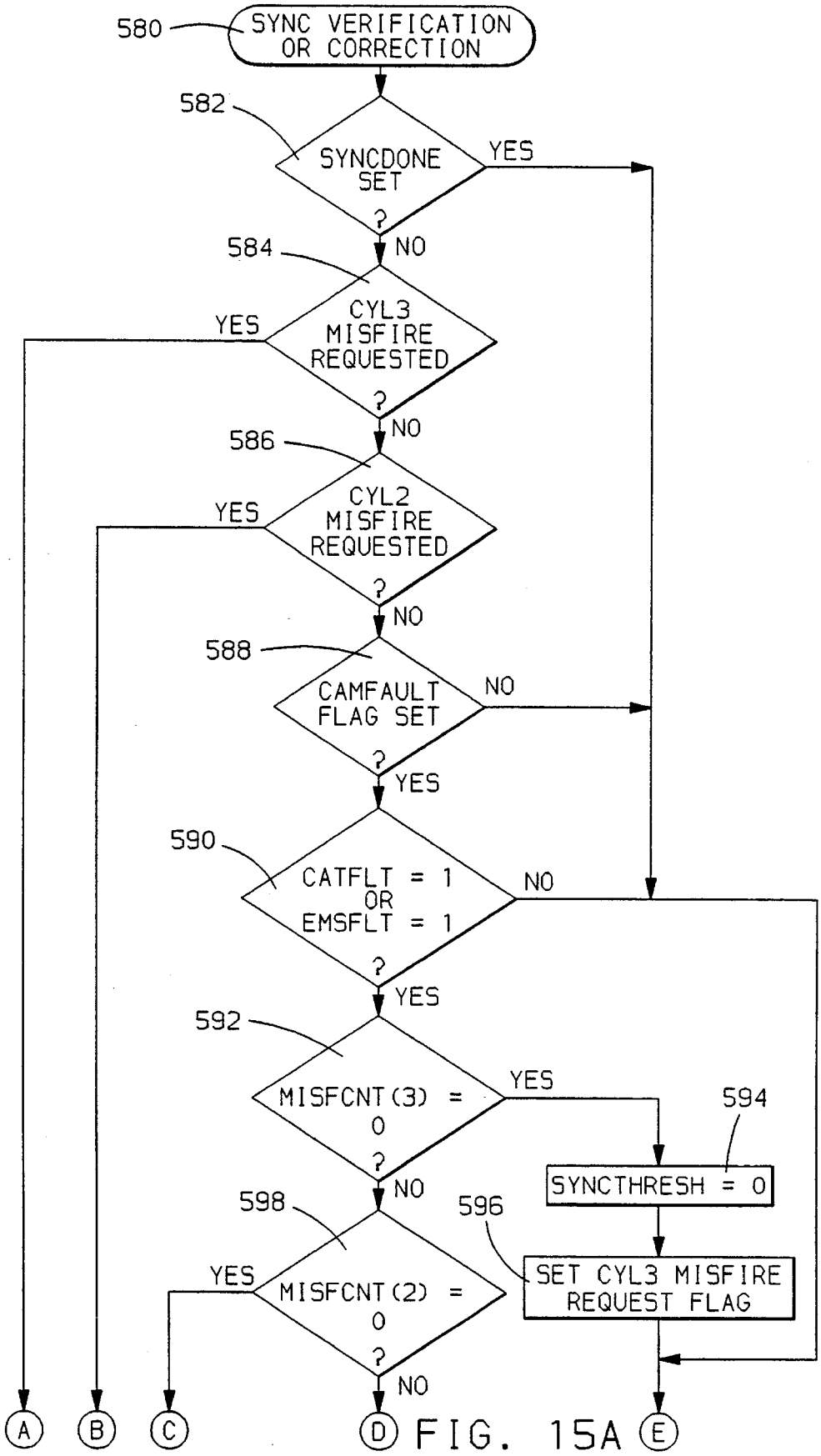
Figure 15B:
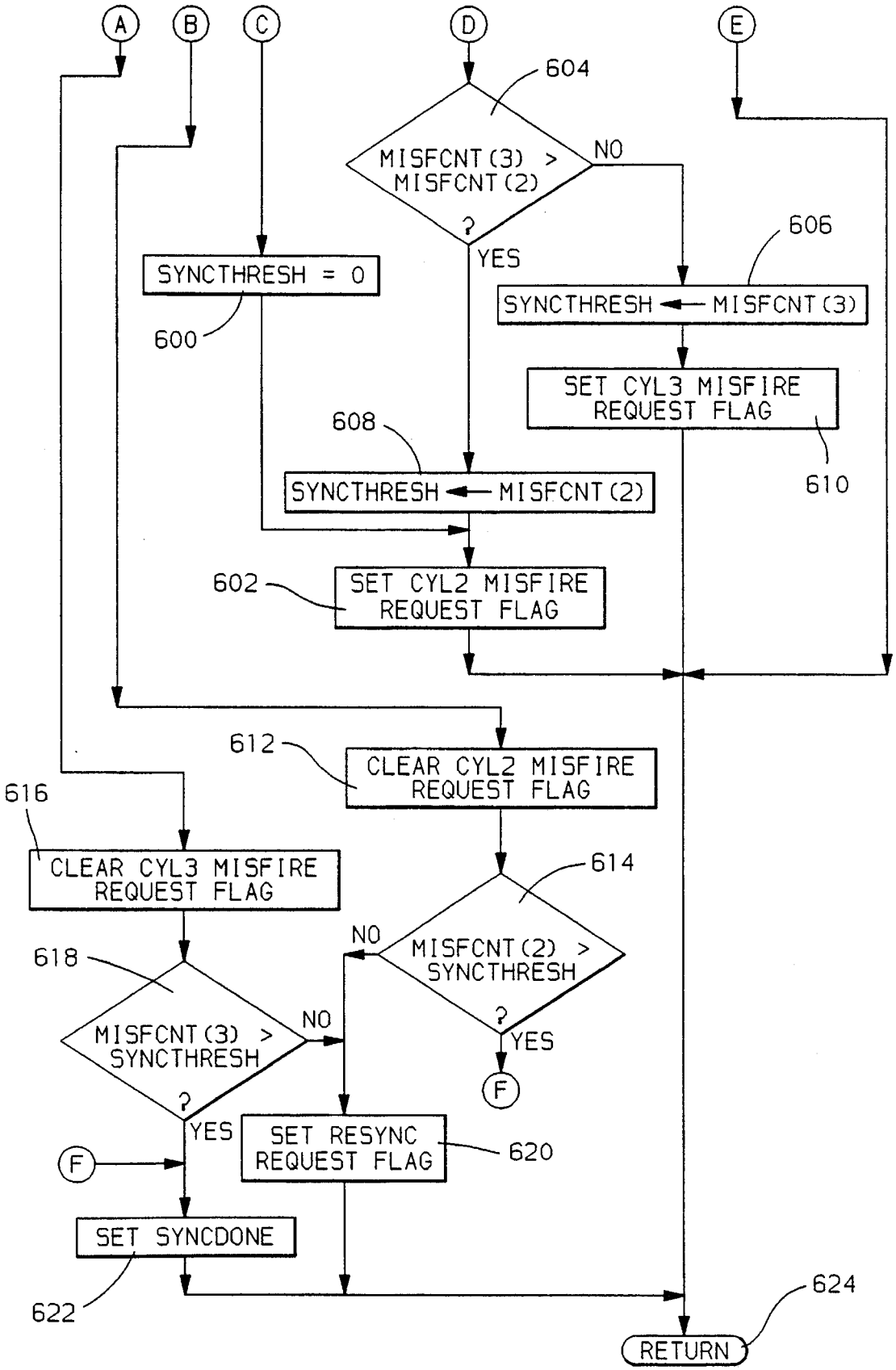

Referring to FIGS. 15*a* and 15*b*, the routine for verifying or correcting engine synchronization is illustrated, and is initiated at a step 580 after being called at the described step 401 of FIG. 13. The routine proceeds next to determine if flag SYNCDONE is set indicating the engine has been synchronized in response to a prior determination of a CAM fault condition. If the engine has already been synchronized following the fault condition, such as through execution of the described routine of FIG. 9, no further CAM position error checking is required, and the routine proceeds from the step 582 to the step 624 to return to the routine of FIG. 13 from which the call to this routine was made.

If SYNCDONE is not set, the synchronization verification or correction is provided by moving to a step 584 to determine if a cylinder 3 (CYL 3) misfire has previously been requested through the operations of FIGS. 15*a* and 15*b* for the most recent prior misfire test period. If a misfire has not been requested, the routine determines whether a cylinder two (CYL 2) misfire has been requested through the operations of the routine of FIGS. 15*a* and 15*b*, at a step 586. If no CYL 2 misfire has been requested, then a flag CAMFAULT is analyzed at a next step 588 to determine if any CAM position sensor fault condition has been diagnosed. A CAM position sensor fault is any diagnosed condition indicating abnormality in the received position sensor signal CAM. For example, a normal CAM signal in a four cylinder engine application should have a synchronization signal that is detected once for every four crank events of the engine from signal RPM. If the ratio of CAM synchronization signals to crank events is not 1:n where n is the number of cylinders of the engine, then an abnormality is present and the flag CAMFAULT is set.

Returning to FIG. 15*a*, if the flag CAMFAULT is not set at the step 588, then no CAM fault is assumed to be present and thus the engine synchronization need not be verified or corrected through operation of the remaining steps of FIGS. 15*a* and 15*b*, and the routine exits via the described step 624. However, if CAMFAULT is set, the operations of FIGS. 15*a* and 15*b* continue by moving to a step 590 to determine if a severe misfire condition has been detected under the CAM fault condition indicated by the flag CAMFAULT being set. Under normal engine operating conditions, a CAM fault condition may lead to a significant misfire condition in the engine 10 (FIG. 1), which would be diagnosed through the misfire diagnostic of this embodiment. If the CAM fault condition is present but a significant misfire condition is not present, then the engine is assumed to not be out of synchronization. The misfire indicators CATFLT and EMSFLT will indicate any significant misfire condition in the engine in accord with the described operations of the routine of FIG. 14. If neither of these indicators is set, the routine exits without further synchronization verification or correction via the described step 624. If either is set however, then the CAM fault condition may have lead to a significant misfire condition due to the engine being out of synchronization, and further verification or correction is needed. In such case, the routine moves to a step 592 to determine if MISFCNT(3), the misfire counter for a misfire test period of about 100 engine cycles in this embodiment, is clear indicating no misfires in cylinder 3 over the most recent completed test period. If the counter is clear, then synchronization verification will be provided by inducing and monitoring misfires in cylinder three. To best distinguish the source of the misfire condition in any cylinder in accord with this invention, it is preferred that misfires be induced in cylinders not currently experiencing misfire conditions. Otherwise misfires occurring through fault conditions in the engine may be interpreted as induced misfires, and vice versa. Accordingly, if MISFCNT(3) is clear as determined at the step 592, a misfire threshold value SYNCTHRESH is cleared for comparison to any later counter misfires in the induced cylinder three at a next step 594, and a cylinder three misfire request flag is set at a step 596. the flag is used to temporarily induce a misfire condition in cylinder three through operation of the described steps of the routine of FIG. 7, for example by temporarily shutting off fuel to cylinder three. After setting the flag at the step 596, the routine is exited via the described step 624.

Returning to step 592, if MISFCNT(3) is not clear, then MISFCNT(2), the misfire counter for cylinder two, is analyzed at a next step 598 to determine if it is clear which indicates that a misfire was not detected for engine cylinder two over the most recent prior test period of 100 engine cycles. If MISFCNT(2) is clear, the misfires shall be induced in cylinder two for engine synchronization verification, by proceeding to a step 600 to clear the misfire threshold value SYNCTHRESH, and then proceeding to a step 602 to set the cylinder two misfire request flag. After setting the flag, the routine exits via the described step 624.

Returning to the step 598, if MISFCNT(2) is not clear, then MISFCNT(3) and MISFCNT(2) are compared at a next step 604 to determine which of cylinders three or two experienced fewer detected misfire conditions over the most recent test period. The cylinder with fewer such conditions is assumed to be the better candidate for misfire inducement, as such induced misfires in that cylinder will likely be more easily distinguished from misfires that are not induced. Accordingly if MISFCNT(3)3 is greater that MISFCNT(2) at the step 604, a step 608 is executed at which the threshold value SYNCTHRESH is set to the current value of MISFCNT(2) and next the cylinder two misfire request flag is set at the described step 602. SYNCTHRESH is set to the value of MISFCNT(2) to determine if additional misfire conditions, beyond those that may already be present as diagnosed during the most recent prior misfire test period, occur in the cylinder two while misfires are being induced in cylinder two.

Returning to the step 604, if MISFCNT(3) is not greater that MISFCNT(2), then cylinder three will be induced by proceeding to a step 606 to set SYNCTHRESH to MISFCNT(3) and then by proceeding to a step 610 to set the cylinder three misfire request flag.

Returning to the step 586, if a CYL 2 misfire has already been requested for previous misfire test period, induced and detected misfires in cylinder two may then be used to verify or correct engine synchronization. Specifically, a step 612 is next executed at which the cylinder two misfire request flag is cleared so that further misfires will not be induced for cylinder two, and the cylinder two misfire counter MISFCNT(2) is next compared to SYNCTHRESH at a step 614. If MISFCNT(2) exceeds SYNCTHRESH, then a significant number of misfires have been detected and attributed to cylinder two over the most recent misfire test period during which misfires have been periodically induced in cylinder two. The engine synchronization is then assumed too be correct, as the misfire detection approach relies on that engine synchronization to identify which cylinder misfired, and a proper identification appears to have occurred. Accordingly, an engine re-synchronization is assumed to not be necessary, and the routine moves to a step 622 to set the flag SYNCDONE to indicate that the engine synchronization has been verified. After setting SYNCDONE, theroutine is exited via the describe step 624. Returning to the step 614, if MISFCNT(2) does not exceed SYNCTHRESH, then a significant additional number of misfires in cylinder two have not been detected over the most recent test period during which misfires were induced in cylinder two. The lack of detection of additional cylinder two misfires is assumed to have been caused by the engine being out of synchronization, wherein the misfires occurred, but were attributed to the wrong cylinder. The misfire detection approach likely attributes such misfires to cylinder three which shares a crank tooth with cylinder two. In such case, re-synchronization of the engine is required so that the crank events will be correctly attributed to engine cylinder events. To provide synchronization correction, the routine moves to a step 620 to set a re-sync request flag which is analyzed at the described step 540 of FIG. 8*b* to determine whether re-synchronization should be carried out. After setting the re-sync request flag, the routine is exited via the described step 624.

Returning to the step 584, if a cylinder three misfire has been requested during the past misfire test period, misfires in cylinder three for that test period are analyzed by moving to a step 616 to clear the cylinder three misfire request flag to prevent further induced misfires in cylinder three, and then MISFCNT(3) is compared to SYNCTHRESH at a step 618 to determine if a significant number of additional misfires occurred during the test period during which misfires were induced in cylinder three. If MISFCNT(3) exceeds SYNCTHRESH, the engine synchronization is assumed to be correct and re-synchronization is avoided by moving to the describe d step 622. If MISFCNT(3) does not exceed SYNCTHRESH, the lack of misfires attributed to cylinder three is presumed to be the result of an improper engine synchronization, and the synchronization is corrected by moving to the step 620 to set the re-sync request flag, as described.

While the above preferred embodiment has been described to incorporate a specific misfire detection approach, which is the approach disclosed in the co-pending U.S. patent application Ser. No. 08/236812, assigned to the assignee of this application, this engine synchronization invention can be applied, through the exercise of ordinary skill in the art, to any misfire detection approach that is capable of diagnosing misfire conditions and of attributing the misfires to individual engine cylinders. By simply inducing misfires in an engine cylinder or engine cylinders, which may be cylinders that historically do not appear to have a high propensity for misfires, and by monitoring such cylinder or cylinders for misfire activity, such as over a test period, and by re-synchronizing the engine in the event such induced cylinder or cylinders do not demonstrate increased misfire activity while induced, the present invention may be carried out for any engine having any number of cylinders. Furthermore, the synchronization approach of this invention may be applied to completely replace the camshaft position sensor by simply adapting the routines described in the preferred embodiment so that they occur following each engine startup. Finally, the present invention may be used together with camshaft position sensing hardware by acting as a camshaft position sensing fault detector, which verifies engine synchronization following each startup of the engine.

The preferred embodiment for the purpose of explaining this invention is not to be taken as limiting or restricting the invention since many modifications may be made through the exercise of skill in the art without departing from the scope of the invention.

The embodiments of the invention in which a property or privilege is claimed are described as follows:

1. An engine synchronization method for synchronizing a periodic input signal with engine cylinder events so the periodic input signal may be interpreted to indicate the occurrence of individual engine cylinder events, comprising the steps of:

inducing a misfire condition in an engine cylinder;

sensing the induced misfire condition;

sensing the periodic input signal;

interpreting the periodic input signal to indicate occurrence of individual engine cylinder events;

identifying the engine cylinder in which the misfire was sensed in accord with the interpreted periodic input signal;

comparing the identified engine cylinder with the cylinder in which the misfire condition was induced;

if the identified engine cylinder is not the cylinder in which the misfire was induced, then adjusting the interpretation of the periodic input signal in accord with a predetermined adjustment to correctly indicate occurrence of individual engine cylinder events.

2. The method of claim 1, further comprising the step of:

sensing a predetermined fault condition; and wherein the misfire is induced after sensing the predetermined fault condition.

3. The method of claim 1, wherein an engine shaft rotates one revolution for each engine cycle during which each engine cylinder undergoes a combustion event, and a position sensor senses when the engine shaft is at a predetermined angular shaft position corresponding to an angular position of the engine within an engine cycle, further comprising the steps of:

receiving an output signal from the position sensor indicating when the engine shaft is at the predetermined angular shaft position; and determining an output signal fault condition when the output signal is not received following occurrence of at least one predetermined engine event;

and wherein the step of inducing a misfire condition induces the misfire condition following the determination of the output signal fault condition.

4. The method of claim 1, further comprising the steps of:

sensing misfire conditions in the engine cylinders over a predetermined test period; and identifying a cylinder from a predetermined set of the engine cylinders having the least number of misfires of the predetermined set of cylinders over the predetermined test period; and wherein the engine cylinder in which the misfires are induced is the identified cylinder.

5. The method of claim 1, further comprising the steps of:

sensing present values of predetermined engine parameters; and determining when the sensed present values correspond to a predetermined robust engine operating condition which is substantially insensitive to engine cylinder misfire conditions; and wherein the step of inducing misfires induces misfires when the sensed present values correspond to the predetermined robust engine operating condition.

6. The method of claim 1, wherein the step of inducing an engine misfire condition induces the condition by temporarily preventing fuel flow to the engine cylinder.

7. A method for determining absolute engine angular position in an engine control system receiving a periodic signal the period of which indicates occurrence of engine cylinder events, comprising the steps of:

inducing a misfire condition in a predetermined engine cylinder;

sensing the misfire condition;

assuming an engine angular position;

synchronizing the periodic signal with the assumed engine angular position so that engine cylinder events indicated by the periodic signal may be attributed to individual engine cylinders;

attributing the sensed misfire condition to an individual engine cylinder in accord with the synchronized periodic signal;

comparing the predetermined engine cylinder to the engine cylinder to which the sensed misfire was attributed; and correcting the synchronization when the predetermined engine cylinder is not the engine cylinder to which the sensed misfire was attributed.

8. The method of claim 7, further comprising the steps of:

sensing misfire conditions in engine cylinders; and selecting an engine cylinder having few misfires relative to the other of the engine cylinders;

and wherein the inducing step induces misfires in the selected engine cylinder.

9. The method of claim 7, wherein the step of inducing a misfire in the predetermined cylinder induces the misfire by temporarily cutting of a supply of fuel to the cylinder so that at least one combustion event in the predetermined cylinder occurs in the absence of the supply of fuel.

10. The method of claim 7, further comprising the steps of:

determining present values for a predetermined set of engine parameters;

establishing an engine operating level in accord with the determined present values; and determining when the engine operating level is within a predetermined range of robust engine operating levels which are substantially insensitive to individual engine cylinder misfire conditions;

and wherein the inducing step induces misfires in the predetermined cylinder when the engine operating level is determined to be within the predetermined range.

11. The method of claim 7, further comprising the steps of:

determining present values for a predetermined set of engine parameters;

establishing an engine operating level in accord with the determined present values; and determining when the established engine operating level is within a predetermined range of robust engine operating levels which are substantially insensitive to synchronization correction; and wherein the correcting step corrects the synchronization when the engine operating level is determined to be within the predetermined range.

12. A method for determining absolute engine angular position in an engine control system receiving a periodic signal each period of which indicates occurrence of engine cylinder events, comprising the steps of:

assuming an engine angular position;

synchronizing the periodic signal with the assumed engine angular position so that engine cylinder events indicated by the periodic signal may be attributed to individual engine cylinders;

sensing engine misfires over an initial test period;

attributing the sensed misfires to the individual engine cylinders in accord with the synchronized periodic signal;

inducing a misfire condition in a predetermined engine cylinder;

sensing engine cylinder misfire conditions over a synchronization test period;

attributing the sensed misfire conditions over both the initial test period and the synchronization test period to individual engine cylinders;

determining that the assumed engine absolute position was correct if the number of misfires attributed to the predetermined cylinder during the synchronization test period was significantly greater than the number of misfires attributed to the predetermined cylinder during the initial test period; and if the assumed engine absolute position was not determined to be correct, then adjusting the synchronization of the periodic signal in accord with a predetermined adjustment value.

* * * * *